US008464900B2

(12) United States Patent
Simson

(10) Patent No.: US 8,464,900 B2
(45) Date of Patent: Jun. 18, 2013

(54) SLED DRIVEN QUEUED ITEM DISPENSER

(76) Inventor: Anton K. Simson, Escondido, CA (US)

( * ) Notice: Subject to any disclaimer, the term of this patent is extended or adjusted under 35 U.S.C. 154(b) by 205 days.

(21) Appl. No.: 12/913,740

(22) Filed: Oct. 27, 2010

(65) Prior Publication Data

US 2012/0024885 A1 Feb. 2, 2012

Related U.S. Application Data

(63) Continuation-in-part of application No. PCT/US2010/032618, filed on Apr. 27, 2010.

(60) Provisional application No. 61/234,606, filed on Aug. 17, 2009, provisional application No. 61/173,575, filed on Apr. 28, 2009.

(51) Int. Cl.
*B65H 3/00* (2006.01)

(52) U.S. Cl.
USPC ..... 221/270; 221/268; 221/165

(58) Field of Classification Search
USPC ..... 221/165, 268, 270, 226, 238, 124
See application file for complete search history.

(56) References Cited

U.S. PATENT DOCUMENTS

| | | | | |
|---|---|---|---|---|
| 2,311,449 | A * | 2/1943 | Lilly | 221/97 |
| 2,880,904 | A * | 4/1959 | Linthicum | 221/125 |
| 4,134,520 | A * | 1/1979 | Collins et al. | 221/129 |
| 4,146,150 | A * | 3/1979 | Low et al. | 221/30 |
| 4,336,892 | A * | 6/1982 | Cox et al. | 221/125 |
| 6,691,891 | B2 * | 2/2004 | Maldonado | 221/279 |
| 6,875,539 | B2 * | 4/2005 | Ophardt | 429/127 |
| 7,258,061 | B2 | 8/2007 | Campbell et al. | |
| 2004/0000558 | A1 | 1/2004 | Parra | |
| 2006/0074524 | A1 | 4/2006 | Chirnomas | |
| 2009/0057333 | A1 | 3/2009 | Simson et al. | |

FOREIGN PATENT DOCUMENTS

| | | |
|---|---|---|
| GB | 0988787 | 4/1965 |
| GB | 2300415 A | 11/1996 |

* cited by examiner

*Primary Examiner* — Timothy Waggoner
(74) *Attorney, Agent, or Firm* — Charmasson, Buchaca & Leach, LLP

(57) ABSTRACT

A machine particularly adapted for dispensing light items packaged in pliable pouches or packets having a machine graspable crowned carrier. The items are propelled in a queue through a tubular cartridge along a track having a ratcheting mechanism to be individually dispensed. A motorized reciprocation bolt engages the mechanism at the back of the cartridge. Multiple cartridges can be grouped together in an expandable array using an interlocking bar and T system to form a removable magazine. Each cartridge can be selectively addressed and activated by its dedicated motorized bolt. In a preferred embodiment of the ratcheting mechanism, the heads of the package carriers are held within a C-shaped track and propelled by the alternating back-and forth motion of a crenelated drive rack successively pushing a sled at the rear of the package queue. A self-engaging brake impedes backward movements of the sled and packages during a return stroke of the drive rack. A coupler is provided for conveniently transferring a batch of products temporarily mounted on a storage and transportation rail directly onto the ratcheting mechanism from the back of a vending machine.

17 Claims, 18 Drawing Sheets

SLED DRIVEN QUEUED ITEM DISPENSER

PRIOR APPLICATION

This is a continuation-in-part of International Patent Application No. PCT/US2010/032618, filed Apr. 27, 2010 designating the United States, which is a continuation-in-part of U.S. Provisional Patent Application Ser. No. 61/234,606, filed Aug. 17, 2009, and a continuation-in-part of U.S. Provisional Patent Application Ser. No. 61/173,575, filed Apr. 28, 2009.

FIELD OF THE INVENTION

This invention relates to mechanisms for propelling a queue of articles along a guide track. More specifically, the invention relates to dispensing mechanisms used in machines for automatically vending articles or substances packaged in symmetrical containers such as the ones commonly used in connection with individual servings of coffee, tea, sugar, shampoo, toothpaste, as well as medicines and cosmetics.

BACKGROUND OF THE INVENTION

In the coffee service industry, individual doses of coffee, tea or chocolate are often offered in small containers, packs, sachets or packets that are configured to be readily inserted in a brewing machine. Such packets sold under the brand name FLAVIA® are commercially available from the Mars Incorporated of McLean, Va. and are generally described in U.S. Pat. No. 7,258,061, Campbell et al., incorporated herein by reference.

Referring now to FIGS. 1 and 2 there is shown a number of beverage container items or packaged articles of the prior art in the form of coffee packets 1 arranged in a queue 2 and slidingly held on a support track 3 for dispensing. Each of the packets 1 has a pouch portion 5 for holding ground coffee formed by a pair of foil-lined plastic sheets bonded along a periphery and is slightly pliable. Each packet uses a substantially rigid plastic, carrier structure 4 secured to the top of the packet which allows the packet to dangle below the track 3 while being slidingly secured to it.

Referring now to FIG. 2, the carrier structure, or simply carrier 4 has a substantially cylindrical shank 20 of given diameter extending upward from the middle of the top edge 21 of the packet 1 on a substantially vertical axis 22. The top end of the shank widens to form a head 23 so that it has an undersurface 24 which slidingly bears against the upper surfaces of the track. The entire weight of the item is thus supported by the head while engaging the track. From the top, the head has a generally slightly elongated octagonal shape so that there are angled surfaces 25 which transition between the substantially flat front edge 26 of the head to the side edges 27 of the head, and from the side edges to the substantially flat back edge 28. The top of the head also has a peripheral upwardly extending wall 18 surrounding an inner indentation 29. In the middle of the indentation is a raised circular frangible nipple 17 providing access to the inside of the pouch.

An array of supports can be arranged in a housing and is usually placed next to the brewing machines for the convenience of employees and customers. In most cases, this type of beverage service is provided and paid for by the employer.

The system is subject to abuses, however. Unscrupulous employees may grab handfuls of containers for use at home. Unsupervised persons, such as maintenance and janitorial crews who frequent the premises during off hours may also be tempted to help themselves to undue quantities of goods.

U.S. Patent Application Publication No. US-2009-0057333, Simson et al., incorporated herein by reference, discloses a tamper resistant vending device having a detachable magazine containing an array of separately activatable cartridges for dispensing one of several queues of items in independent cartridges using a pneumatic driving means. Such a system is not readily adaptable to dispensing the carrier topped packets described above.

In many vending contexts, maintaining a large number of customer choices is preferred. For example, a single vending machine may seek to provide a variety of coffee selections. Depending on the vagaries of consumer habits, some varieties may run out quicker than others prompting restocking. Restocking of a dispenser located at a customer site often requires the time-consuming task of manually loading of the packets onto their supports from the front of the support. It is generally preferred that restocking frequency of a machine is kept to a minimum because of the cost associated with an operator visit.

The items can be supplied in a queue on a storage or transportation rail oriented at an acute angle with respect to the major axis of the rail so that the width of the queue is reduced to facilitate greater packing density of a number of storage or transportation rails.

There is a need to find a convenient solution to the controlled presentation and dispensing of small packaged articles.

SUMMARY OF THE INVENTION

The invention provides a simpler, less expensive, and/or more efficient way to store, transport, restock, display and/or dispense small packaged items under some form of paid or verifiable accounting to authorized or paying customers.

One of the main advantages of the invention is the ability of loading a batch of products onto the dispensing mechanism from the back rather than from the front of the vending machine. It also allows the rapid transfer of a batch of products mounted on a temporary storage and transportation rail directly into the vending machine by way of a convenient coupler.

The invention offers a device for selectively dispensing a plurality of items, wherein each of said items has a carrier uniformly shaped and dimensioned with respect to others of said items, said device comprises: at least one elongated track for carrying a queue of said items, said track comprising: an elongated channel having a frontal dispensing aperture, a back loading aperture, a cross-section commensurate with a cross-sectional dimension of said carrier; and, a ratcheting mechanism alternately allowing dispensing of a first one of said items through said frontal aperture and holding back a second one of said items next in line behind said first one; wherein said ratcheting mechanism comprises: a rack slidingly and reciprocatingly secured with respect to said track, said rack having a drive motion and a reset motion; said rack carrying a plurality of spaced apart ratchet fingers arranged to successively engage and drive forward said carriers while said rack moves in a drive stroke; and, a friction structure retaining each of said carriers from moving backward while said rack moves in a reset stroke.

In some embodiments said friction structure comprises a series of static pawls arranged along said track to successively bear against a surface of said carriers remaining on said track while said rack moves in a reset stroke.

In some embodiments the friction structure provides greater friction to backward movement of said carriers and lesser friction to forward movement of said carriers.

In some embodiments the friction structure further comprises a roughened surface oriented to contact said carriers during both of said drive and reset strokes.

In some embodiments the device further comprises: a plurality of said tracks are assembled into a magazine; a base unit comprising a cradle shaped and dimensioned to lockingly nest a portion of said magazine; and means for selectively activating a drive stroke in one of said plurality of tracks.

In some embodiments the cradle provides a fulcrum surface oriented to bear against said magazine causing angular movement of said magazine.

In some embodiments the magazine is detachable from said base unit.

In some embodiments the means for activating comprise a reciprocating motor driven bolt oriented to mechanically engage said rack and thereby cause said drive stroke.

In some embodiments the device further comprises: a motor having a rotatable shaft; a linkage between said shaft and said bolt, said linkage comprising: a substantially circular disk rotatively held within a bearing, said disk having an axis of rotation; a pin radially spaced apart from said axis; and, said bolt having an oblong slot slidingly and rotatively engaged by said pin.

In some embodiments the magazine comprises a modular arrangement of spaced apart plates and crosspieces mechanically securing said tracks within an array of cartridges, wherein an additional one of said plates adds either a row or column to said array.

In some embodiments the device further comprises: said items being mounted on a loading rail; a coupler mounted to said back loading aperture, said coupler having a first interface for releasably mating to an end of said loading rail, said coupler being shaped dimensioned and located to form a open interfacing channel between said loading rail and said elongated channel.

In some embodiments the device further comprises: said at least one track having a U-shaped cross section, parallel side walls and inwardly extending retaining flanges; wherein said carrier includes a head engaged into said track and a shank projecting from said head between said flanges; wherein said first rack is a drive rack inserted into said track and having a plurality of substantially sawtooth-shaped prominences shaped and positioned to capture and propel said head when said drive rack his held in a first transversal position and is moved axially in a first axial direction, and to course over said head when said drive rack into a second transversal position; wherein said friction structure comprises a locking rack inserted into said track parallel to said drive rack and having a plurality of edge indentations positioned to capture and immobilize said head when said locking rack is held in a first crosswise location and to free said head when translated into a second crosswise location; said locking rack being translated into said second location when said drive rack is moved axially in said first direction; and a mechanism for alternately moving said drive rack in said directions.

In some embodiments the device further comprises: a push rod having a flat side riding against said drive rack; and a first nib projecting from said side into an oblique groove in said drive rack.

In some embodiments the device further comprises said locking rack being translated into said first location when said drive rack is moved into a second direction opposite said first direction.

In some embodiments each of said indentations has a ramping edge coming into contact with said head when said drive rack is moved into said first direction.

In some embodiments the device further comprises said locking rack being returned to said first location upon when said head reach a next successive indentation.

In some embodiments the device further comprises: a support plate running against a surface of said locking rack; and a second nib projecting from said surface into an oblique groove in said support plate.

In some embodiments the device further comprises: a first resilient member shaped and placed to bias said drive rack toward said first position; and a second resilient member shaped and placed to bias said locking rack toward said first location.

In some embodiments said first resilient member is contained within a trough located in said drive rack and contacts a structure outside said drive rack.

In some embodiments the device further comprises: said mechanism comprises: a spring resiliently biasing said push rod toward one of said directions; and an actuator successively pulsing said rod against said spring.

In some embodiments said head further comprises: a first section positioned to ride along said locking rack; and a second section positioned to ride along said drive rack.

In some embodiments said first section has a polygonal periphery having at least three parallel pairs of sides.

In some embodiments the device further comprises: said items being mounted on a loading rail; a coupler mounted to said back loading aperture, said coupler having a first interface for releasably mating to an end of said loading rail, said coupler being shaped dimensioned and located to form a open interfacing channel between said loading rail and said elongated channel.

In some embodiments the device further comprises: a series of said carrier, each supporting a flat package from said shank in a first package orientation, and wherein each of said first section has a polygonal periphery having at least three parallel pairs of sides, and wherein two adjacent ones of said sides define a given sharp angle; whereby said package may be supported in one of a plurality of orientations; a rail engaging a plurality of said package supporting carriers in a first orientation; a transfer mechanism for transferring a plurality of said package supporting carriers in a second orientation to said conveyor; wherein said transfer mechanism comprises: a track portion having a first extremity shaped and dimensioned to mate with a loading end of said track; a rail portion having a first extremity shaped and dimensioned to mate with a unloading end of said rail; and said first and second portions having second extremities obliquely bonded together at said angle.

In some embodiments the invention further provides an alternate ratcheting device for stepping a queue of article carriers along a conveyor which comprises: a first track having a U-shaped cross section, parallel side walls and inwardly extending retaining flanges; at least one carrier including a head engaged into said track and a shank projecting from said head between said flanges; a drive rack inserted into said track and having a plurality of edge prominences shaped and positioned to capture and propel said head when said drive rack his held in a first transversal position and is moved axially in a first axial direction; means for retracting said drive rack into a second transversal position; a locking rack inserted into said track parallel to said drive rack and having a plurality of sawtooth-shaped indentations positioned to capture and immobilize said head when said locking rack is held in a first crosswise location and to free said head when translated into a second crosswise location; means for translating said locking rack into said second location when said drive rack is moved axially into said first direction; and a mechanism for alternately moving said drive rack in said directions.

In some embodiments the means for retracting comprise: a push rod having a flat side riding against said drive rack; and a projecting from said side into an oblique groove in said drive rack.

In some embodiments the ratcheting device further comprises means for translating said locking rack into said first location when said drive rack is moved into a second direction opposite said first direction.

In some embodiments the means for translating comprise: each of said indentations having a ramping edge coming into contact with said head when said drive rack is moved into said first direction.

In some embodiments the ratcheting device further comprises means for returning said locking rack to sais first location.

In some embodiments the means for returning comprise: a support plate running against a oversurface of said locking rack; and a nib projecting from said oversurface into an oblique groove in said support plate.

In some embodiments the means for retracting and said means for returning further comprise: a first resilient member shaped and placed to bias said drive rack toward said first position; and a second resilient member shaped and placed to bias said locking rack toward said first location.

In some embodiments the mechanism for moving the drive rack comprises: a spring resiliently biasing said push rod toward one of said directions; and an actuator successively pulsing said rod against said spring.

In some embodiments the head of the carrier further comprises: a first section positioned to ride along said driving rack; and a second section positioned to ride along said locking rack.

In some embodiments the first section has a polygonal periphery having at least three parallel pairs of sides.

In some embodiments the periphery of the first section is octagonal.

In some embodiments the ratcheting device may further comprises: a series of said carrier, each supporting a flat package from said shank in a first package orientation, and wherein each of said first section has a polygonal periphery having at least three parallel pairs of sides, and wherein two adjacent ones of said sides define a given sharp angle; whereby said package may be supported in one of a plurality of orientations; a rail engaging a plurality of said package supporting carriers in a first orientation; means for transferring a plurality of said package supporting carriers in a second orientation to said conveyor; wherein said means for transferring comprises: a first rail portion having a first extremity shaped and dimensioned to mate with a loading end of said first rail; a second rail portion having a first extremity shaped and dimensioned to mate with a unloading end of said second rail; and said first and second portions having second extremities obliquely bonded together at said angle.

The content of the original claims is incorporated herein by reference as summarizing features in one or more exemplary embodiments.

DESCRIPTION OF THE EXEMPLARY EMBODIMENTS

Figure 1:
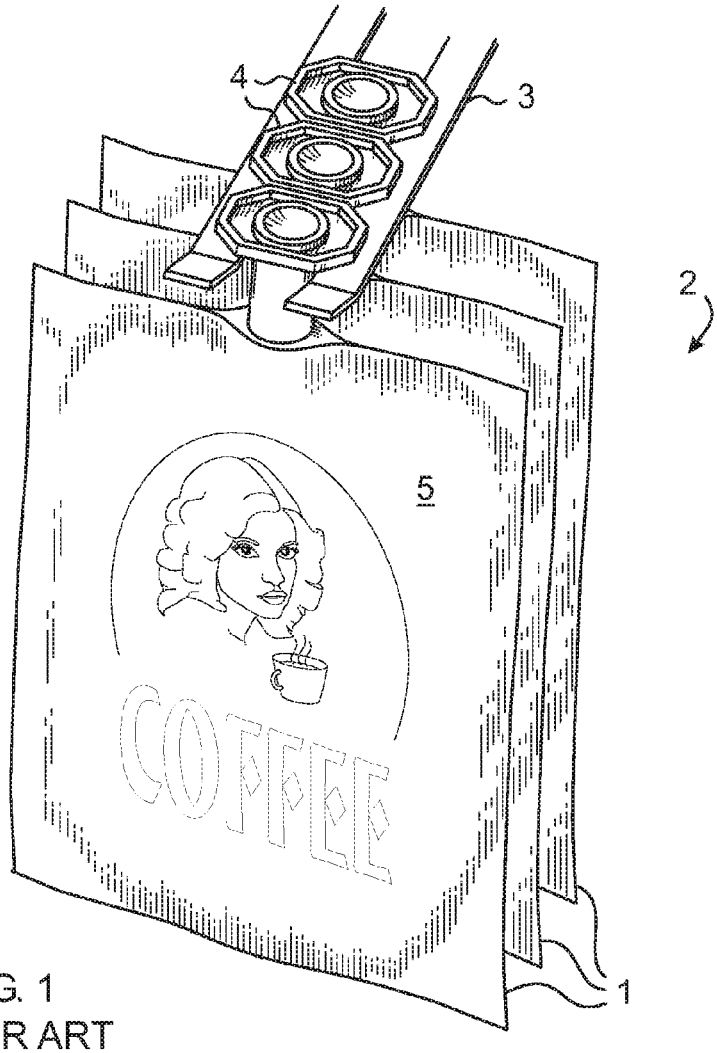
FIG. 1 PRIOR ART
FIG. 1 is a diagrammatic perspective view of a queue of beverage item packets of the prior art each having a top carrier structure slidingly mounted to a dispensing support.
Figure 2:
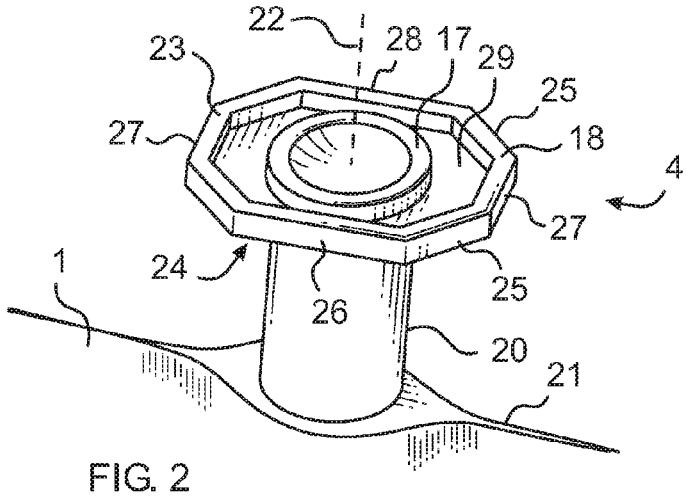
FIG. 2 PRIOR ART
FIG. 2 is a close up diagrammatic perspective view of the carrier structure of the packet of FIG. 1.
Figure 3:
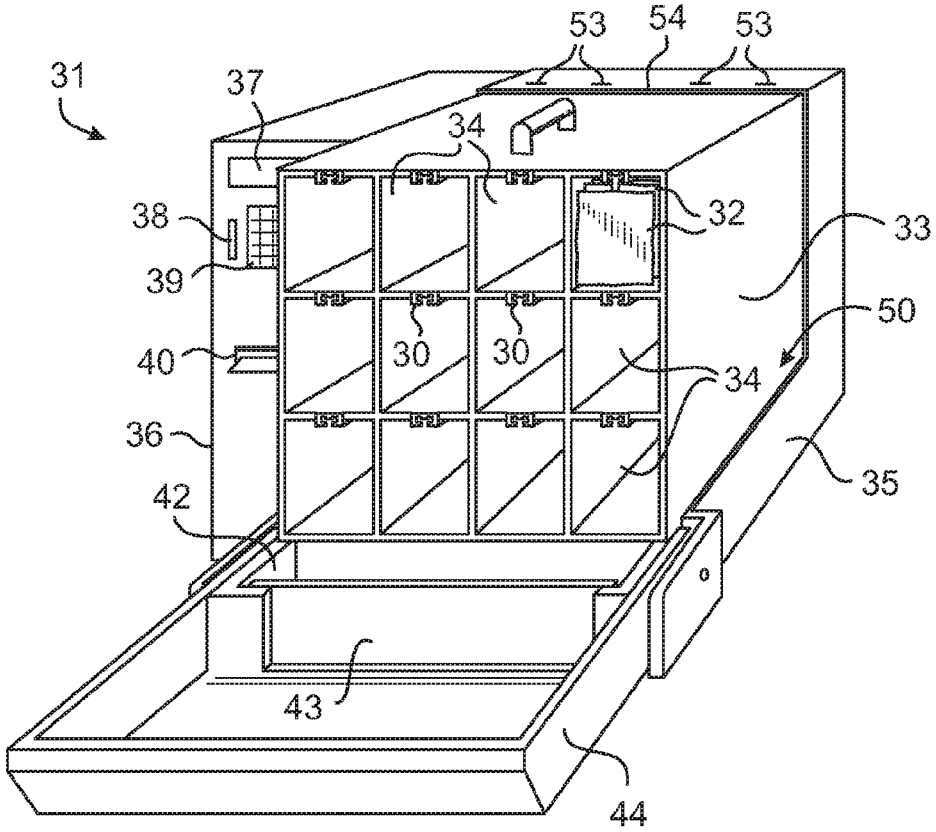
FIG. 3 is a diagrammatic perspective view of beverage item dispensing machine according to an exemplary embodiment of the invention.
Figure 4:
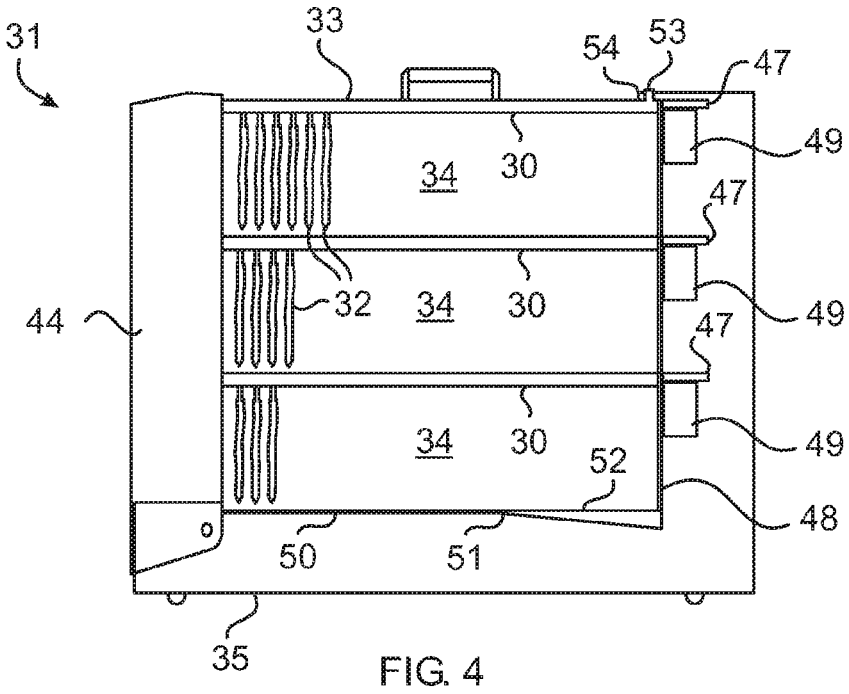
FIG. 4 is a diagrammatic left side view of the machine with the magazine cover closed.

Referring now to the drawing, there is shown in FIGS. 3-4 a vending machine 31 particularly adapted to dispense a number of different items packaged in lightweight packets 32 made of pliable martial such as paper or plastic. In this particular embodiment, the machine is intended to dispense individual servings of coffee or other beverages such as FLAVIA® brand coffee, tea and chocolate packs commercially available from the Mars Incorporated of McLean, Va. The machine accommodates a removable magazine 33 that groups an array of cartridges 34 each potentially holding a different type of packeted product 32 in a queue dangling from a track 30.

The base 35 of the machine forms a cradle 50 which is adapted to closely nest the magazine 33 in alignment with a rear plate 48 carrying a commensurate array of linkages 47 between each track and a dedicated actuating motor 49. A fulcrum structure 51 is formed onto an upper surface of the cradle in the base unit 35 to bear against the undersurface 52 of the magazine. The magazine is installed by inserting its back end at a downward angle into a recess formed in front of the rear plate 48 so that a series of projections 53 extending from the upper surface near the rear of the magazine pass underneath the upper ledge 54 of the base unit overhanging the recess. The magazine is then rocked forward on the fulcrum in order to lower the front end and raise the back end, thereby engaging the projections into corresponding holes in the upper ledge. This causes the magazine to closely align itself with the rear plate so that the motor linkages are properly engaged. When the front of the magazine snaps down the magazine is thus locked into place and the cover 44 can be closed. Once the magazine 2 is installed on the machine and the cover has been shut and locked, the magazine cannot be removed.

The base 35 can also house mechanisms that further control and protect the dispensing of the goods out of the cartridges. A dispensing pocket 42 for the goods is provided in the frontal portion of the base. The pocket is accessible by pushing a flap door 43. The front of the machine is sealed by a cover 44 whose transparent face permits viewing of the first item in each cartridge.

An electronic control unit 36 provides an interface with the user of the machine by way of an alpha-numeric readout 37, an electronic data media reader 38, an alpha-numeric keypad 39, and a cash acceptor 40.

Each tubular quadrangular cartridge 34 has a substantially rectangular cross-section which loosely contains the symmetrical items 32 to be dispensed which are lined up one-behind-the-other in a queue. Each item has a carrier projecting vertically from the item which slidingly engages the ratcheting track 30 extending longitudinally along the ceiling of the cartridge, which will be described in greater detail below.

Figure 5:
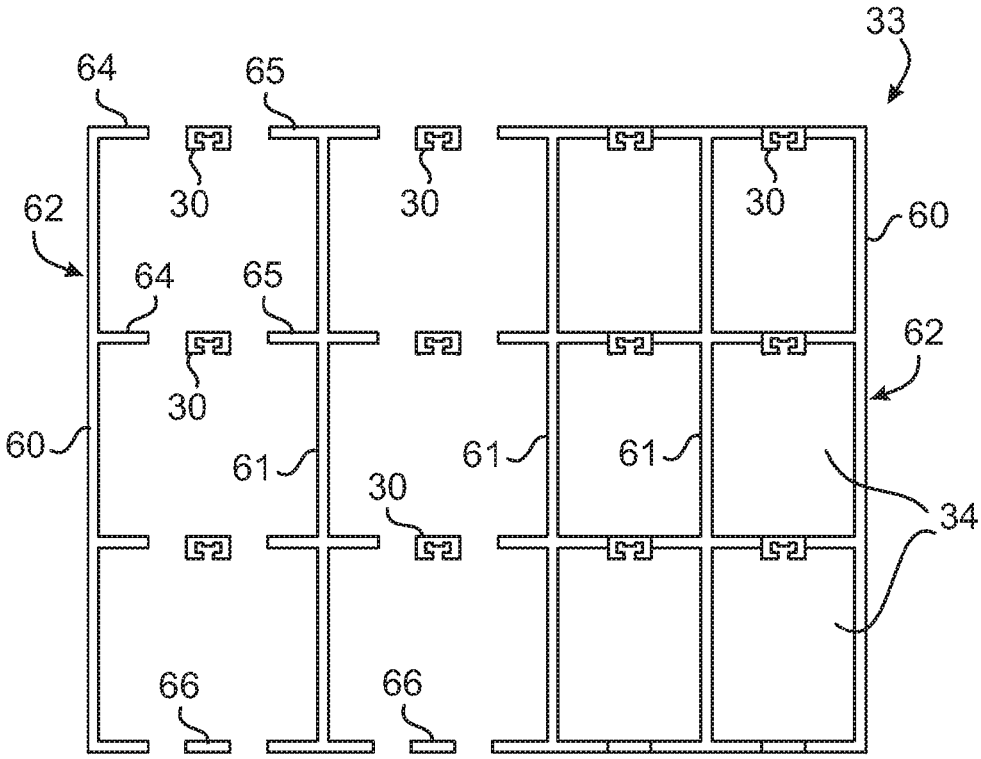
FIG. 5 is a diagrammatic front elevational and partially exploded view of an array of cartridges forming a magazine.

Referring now to FIG. 5, the array of cartridges 34 are formed by a number vertically oriented panels 60,61 which interlock with each of the tracks 30. A pair of side panels 60 having smooth outer surfaces 62 form the side walls of the magazine 33. A number of internal panels 61 are spaced apart equidistantly to define the lateral extent of each cartridge. Crosspieces 64,65 interlock with the tracks to define the vertical extent of each cartridge. Along the bottom of the magazine, spacers 66 are used to bond crosspieces to one another in place of unneeded tracks. Various tongue-in-groove, or other commonly used interlocking structures can be used on the parts of the panels, crosspieces, spacers and tracks which bond to one another in order to ruggedize the magazine. Each panel can be easily assembled from rigid durable sheets of plastic or metal interlocked with the rigid durable plastic or metal crosspieces. Those skilled in the art will readily appreciate the modular nature of the panel arrangement and its expandability to form additional rows or columns of cartridges.

Figure 6:
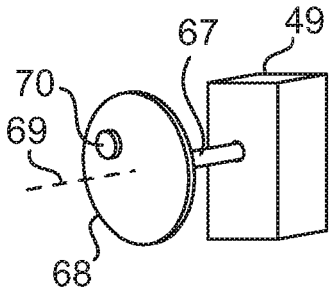
FIG. 6 is a diagrammatic perspective view of a motor having an eccentric pin.
Figure 7:
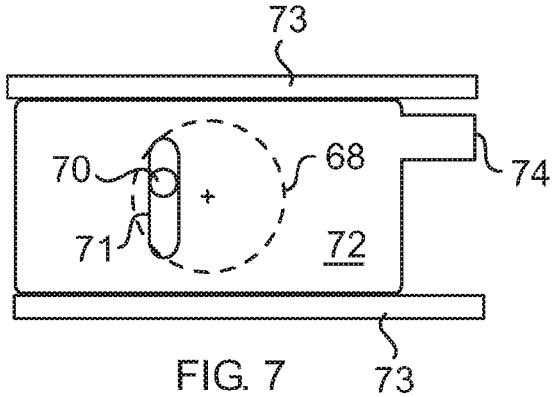
FIG. 7 is a diagrammatic front view of the actuation bolt in a retracted position.
Figure 8:
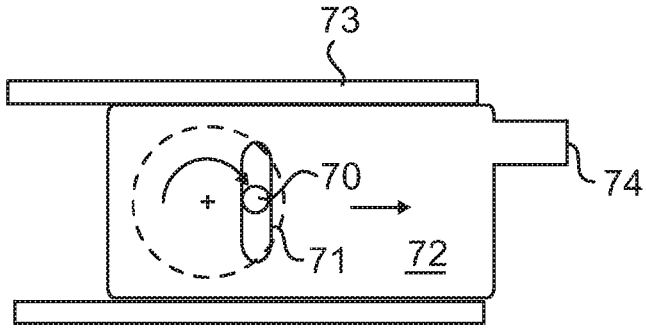
FIG. 8 is a diagrammatic front view of the actuation bolt in a extended position.

Actuation of the ratcheting mechanism comprises a drive stoke, followed by a reset stoke. Although a solenoid-type actuation device can be used, the preferred actuation device uses a rotary motor. Referring now to FIGS. 6-8, there is shown a motor 49 for actuating a tracked dispenser associated with a particular cartridge. The motor has a turning shaft 67 connected to a disk 68 which has an axially extending pin 70 located a radial distance from the rotational axis 69 of the disk and this can be said to be a radially eccentric pin. The pin slidingly engages an oblong oval slot 71 in a bolt 72 slidingly mounted to a guideway 73. The bolt has an engagement prong 74 oriented to contact the rear of the track and activate its ratcheting mechanism described below.

FIG. 7 shows the position of the bolt 72 after a reset stoke where the bolt is essentially in its fully retracted position.

FIG. 8 shows that during a drive stroke, after one half turn of the motor shaft, the pin 70 has coursed to the top of the slot 71 and back down again, and caused the bolt 72 to slide forward in its guideway 73, and cause the engagement prong 74 to actuate the track ratcheting mechanism drive stroke which causes the queue of packets to move longitudinally forward ejecting the frontmost packet. In this way, a less powerful and hence inexpensive and lightweight rotary electrical motor can be used. In addition, the sliding bolt linkage can have a narrow cross section which allows it to operate in the restricted confines of the base unit. In addition, this type of linkage allows for a high degree of mechanical isolation between the motors and the rest of the machine, this decreasing the noise.

Figure 9:
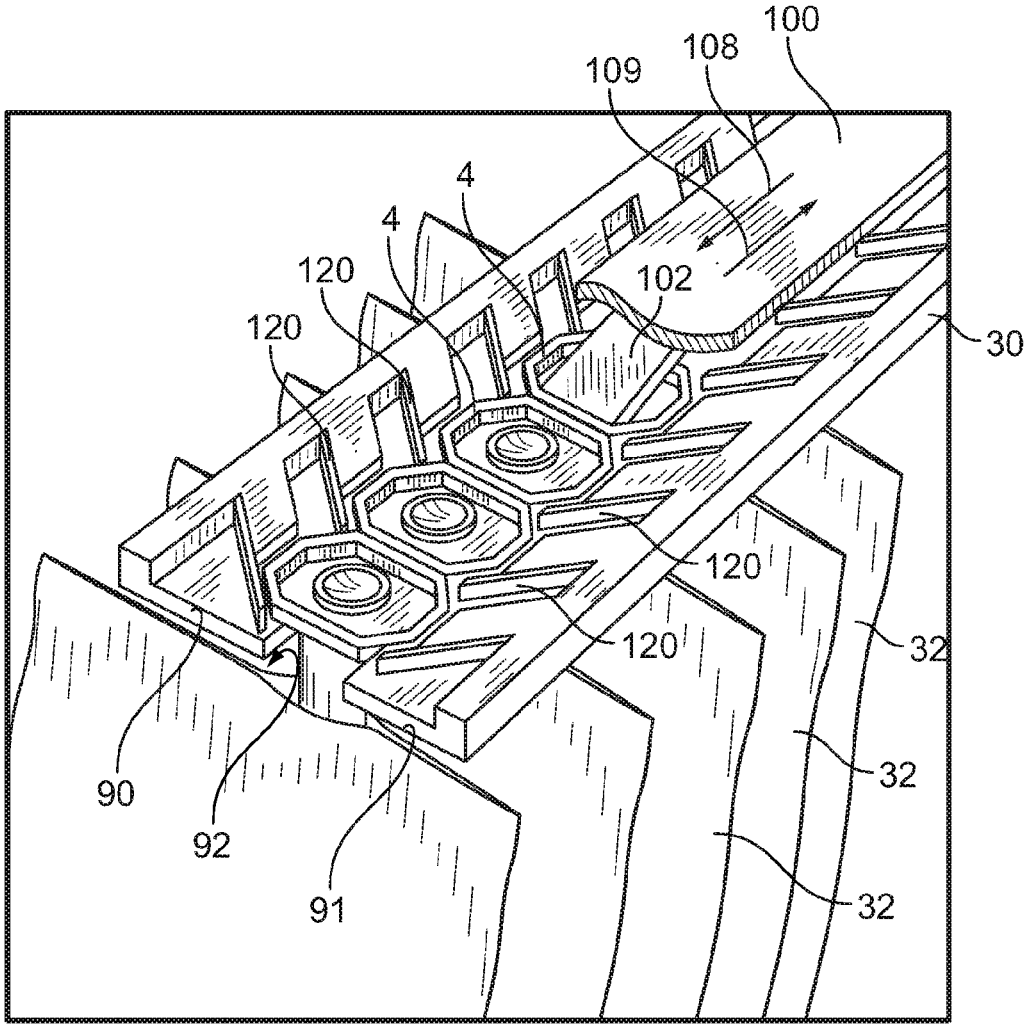
FIG. 9 is a diagrammatic partial cutaway perspective view of the track carrying a queue of packets.
Figure 10:
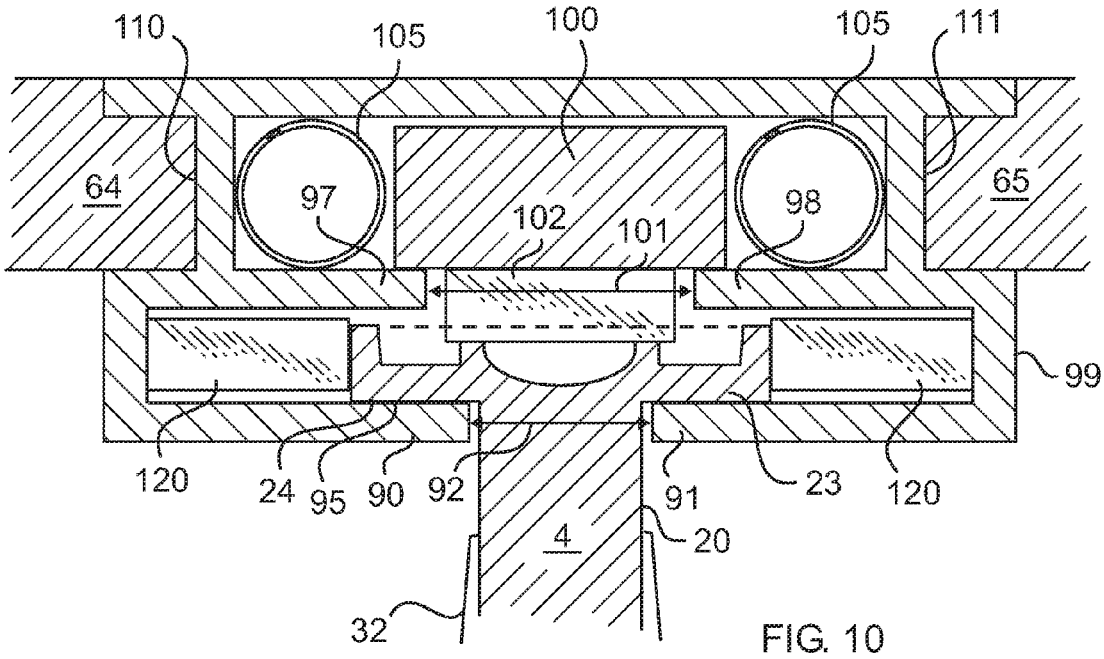
FIG. 10 diagrammatic cross-sectional end view of the track.

Referring now to FIGS. 9-10, there is shown a queue of packets 32 having their carriers 4 slidingly carried by a track 30. Some of the components of track have been removed in FIG. 9 for clarity. The track is generally an oblong extruded structure having a pair of laterally and inwardly extending lower flanges 90,91 form the support for the packets. The flanges are spaced apart to form an opening 92 through which the shank 20 of each of the carriers passes. The shape and dimension of the flanges and opening are selected to accommodate uninhibited passage of the packet carrier therethrough. Therefore, the width of the opening is at least as large as the diameter of the carrier shank.

The upper surfaces 95 of the flanges form a bearing surface for bearing against the undersurface 24 of the carrier head 23. In this embodiment it is intended that the carrier slide freely longitudinally along the flanges. However, as will be described below, the friction between the flanges, or other parts of the track, and the carriers can be adjusted to inhibit backward motion of the packets during a reset motion of the drive rack.

The track also has a pair of upper shelves 97,98 extending laterally inwardly toward one another to form a support for the drive rack 100. The upper shelves are spaced apart to form a gap 101 through which extends a plurality of equidistantly spaced apart flexible ratcheting fingers 102 from the bottom of the drive rack. The fingers can be made from rigid plastic formed into thin sheets to enhance flexibility. The fingers are pitched downward toward the front to contact the tops of the heads of the carriers 4. The width of the gap is at least as large as the lateral width of the ratcheting finger. The upper surfaces of the upper shelves form a bearing surface for bearing against the undersurface of the side ledges of the drive rack. The drive rack ledges slide freely longitudinally against the upper surfaces of the upper shelves as the rack moves forward 108 during a drive stroke and backward 109 during a reset stroke. Drive rack is moved forward by the push of the prong in the motor linkage. The rack is moved backward during a reset stroke through the force of one or more coil compression springs 105 housed within the track. One end of the spring bears against an endplate of the track and the opposite end bears against an endplate on the rack.

The track 30 also has a peripheral framework 99 to fix the positions of the upper shelves 97,98 and lower flanges 90,91 and to enclose and protect the moving parts of the track. The framework provides a pair of lateral interface grooves 110, 111 to secure the track to corresponding laterally projecting tongues or adjacent crosspieces 64,65 formed into the ceiling of the cartridge.

Figure 11:
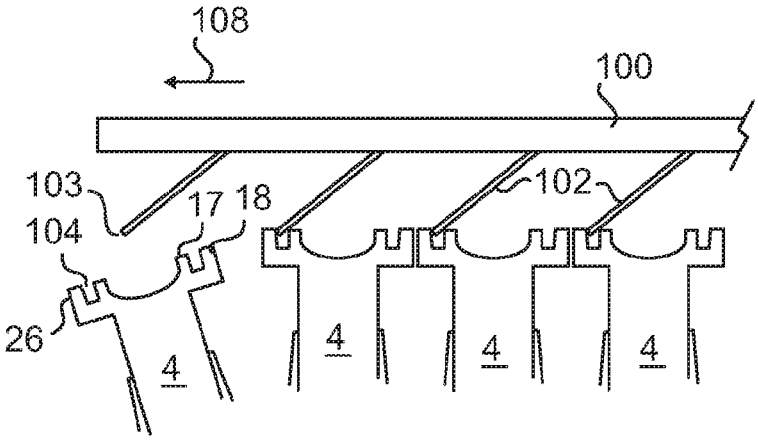
FIG. 11 diagrammatic side elevational view of a queue of carriers being pushed forward by a series of ratcheting fingers during a drive stroke.
Figure 12:
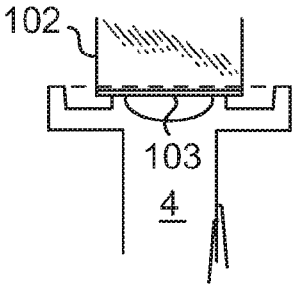
FIG. 12 diagrammatic front elevational view of a carrier head engaged by a ratcheting finger during a drive stroke.

As shown in FIGS. 11-12, during a drive stroke, the bottom edge 103 of each finger 102 is oriented to engage the notch 104 formed in the upper surfaces of the front 26 of the head, between the head's peripheral wall 18 and the central nipple 17. Thus the bottom edge of the finger extends below the level 107 of the top of the peripheral wall of the head. This provides for a positive transfer of force from the rack to the carriers.

Figure 13:
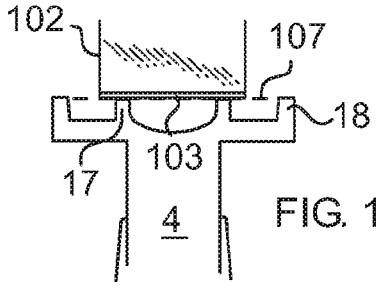
FIG. 13 diagrammatic front elevational view of a carrier head where a ratcheting finger raises over top of the flange during a reset stroke.

In FIG. 13, during a reset stroke, the rack 100 moves in the backward direction causing the bottom edge 103 each ratcheting finger 102 to move upward over the static carrier, thus bending the flexible finger. The bottom edges raises above the level 107 of the top of the head's peripheral wall 18 and central nipple 17.

Referring now to FIGS. 9-10 and 14-15, the track 30 has a friction structure which causes the carriers 4 to remain in place while the drive rack 100 retracts during a reset stroke. In this embodiment the friction structure is formed by a plurality of equidistantly spaced apart flexible static pawls 120 extending laterally from the sides of the track toward the channel 92 above the lower flanges 90, 91 and below the upper shelves of the track. The pawls can be made from material similar to the ratcheting fingers. Each pawl is yawed centrally forward so that its medial end 121 extends toward and contacts the lateral edges of a carrier head.

Figure 14:
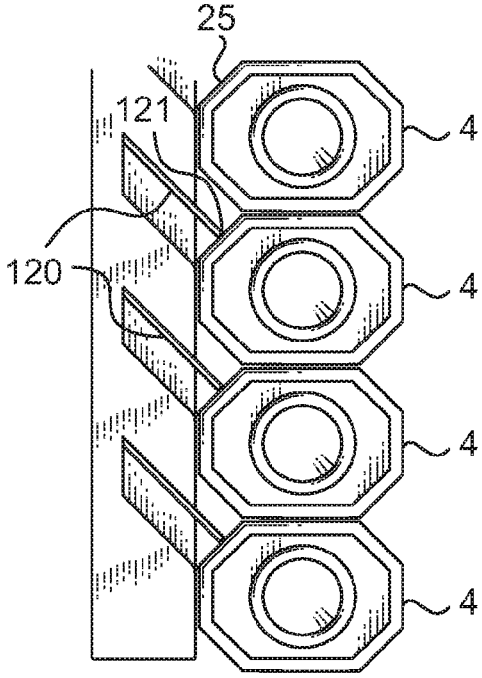
FIG. 14 diagrammatic top view of a queue of carriers held by the friction structure during a reset stroke.

As shown in FIG. 14, during a reset stroke, the medial end 121 of the pawl 120 engages the angled surface 25 of the head 23 of the carrier 4. Because of the angled orientation of the pawl any rearward force provided by the carrier is carried longitudinally along the pawl resisting its deflection. Thus, the carriers are frictionally prevented from moving backward during a reset stroke.

Figure 15:
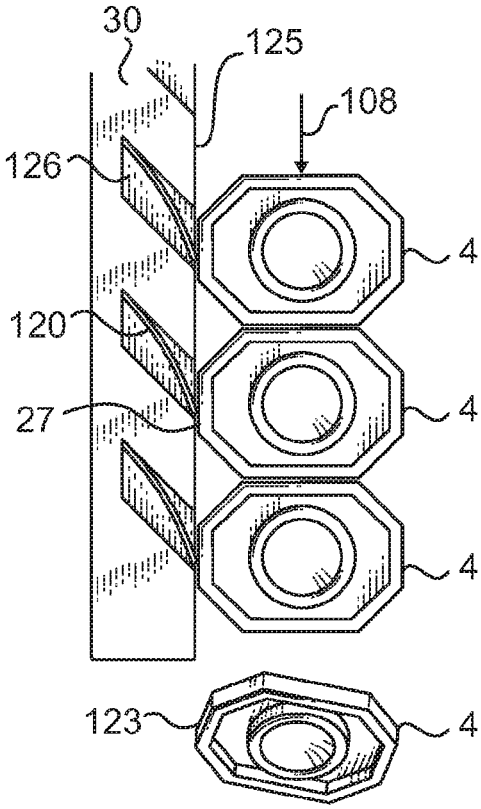
FIG. 15 diagrammatic top view of a queue of carriers being pushed forward by a drive stroke.

In FIG. 15, during a drive stroke, the carriers 4 are moved in the forward direction 108 by the drive rack (not shown). The pawls 120 are deflected outwardly away from the center of the track by movement of the carriers. Thus ejecting the frontmost packet carrier 123. The lateral sides 27 of the carrier heads are guided by contacting longitudinal lateral guide surfaces 125 situated between the upper shelves and lower flanges. Parallelogram shaped notches 126 are formed into the guide surfaces to accommodate the pawls 120 as they bend out of the way of the heads during a drive stroke. In this way the static pawls can be said to act as unidirectional friction elements, or directionally differential friction elements.

It shall be understood that the static pawls can be replaced by a friction element that is overcome by the force of the rack during a drive stroke, but that is not overcome by the force on the carriers in a reset stroke. In other words, the amount of friction can be selected to prevent the carriers from moving backwards during the reset motion of the drive rack. As the ratchet fingers of the rack are drawn backwards over the carriers, they will tend to impart a slight force in the reverse direction. However, that force is insufficient in overcoming the friction selected. Such a frictional element can be implemented using a surface roughening of the guide surfaces described above. Conversely, during a drive stroke, the force imparted on the carriers easily overcomes the friction. In addition, the friction element can be selected to act more like the pawls, having a higher coefficient of friction against reverse movement of the carriers and a lower coefficient of friction against forward motion of the carriers.

While the exemplary embodiment of the invention has been limited to a three-by-four array of cartridges, it must be understood that much larger magazine can be used with corresponding increase in motors and actuators. The cartridges can be shaped to accommodate a variety of packages not necessarily of a rectangular geometry. The spacing and dimensioning of the track mechanisms may be adjusted to accommodate differently shaped and sized carriers.

Referring now to FIGS. 16-24, there is shown the components of an alternate embodiment of a ratcheting device 127 used to transport and dispense a series of packaged articles 128 supported by carriers 129.

Figure 16:
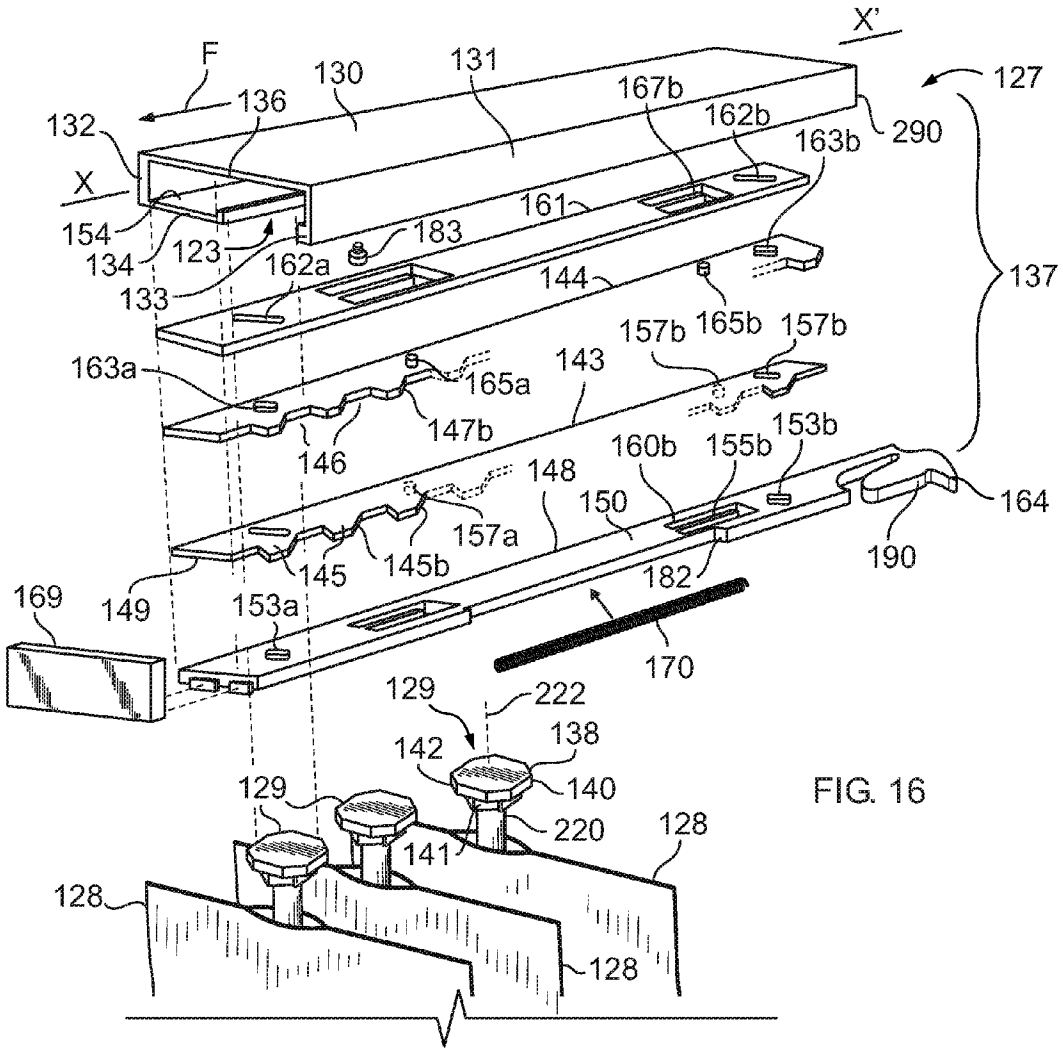
FIG. 16 is an exploded perspective view of an alternate embodiment of the ratcheting mechanism.
Figure 17:
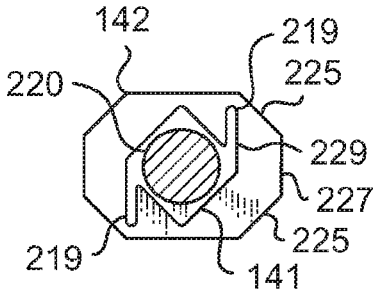
FIG. 17 is a partial cross-sectional bottom plan view of the head of a carrier in the alternate embodiment of the ratcheting mechanism.

As shown in FIGS. 16 and 17 each carrier 129 comprises a head 138 from which projects along a substantially vertical axis 222, a substantially cylindrical shank 220 secured at a distal end to the package 128. The head includes an upper first section 140 and a lower second section 141 both centered on the axis of the shank 220. The first section has a polygonal periphery 142 featuring at least three pairs of parallel sides preferably an oblong octagonal one as shown. The second section has a lesser diameter than the first. As shown in FIG. 17, the periphery of the second section 141 can be shaped to have a pair of tangentially and oppositely extending prongs 219. A similar head is used on some FLAVIA® brand coffee packages commercially available from the Mars Incorporated of McLean, Va. This shape allows the packages to be queued on a loading rail in an orientation which is rotated approximately 45 degrees with respect to the axis of the shank. This provides the queue with a narrower lateral cross section to help reduce lateral bulkiness during transport.

The carriers are engaged into a U-shaped oblong track 130 having parallel side walls 131, 132 and flanges 133, 134 projecting inwardly from the bottom edges of the walls. Each carrier shank 220 passes between the flanges 133, 134.

Figure 18:
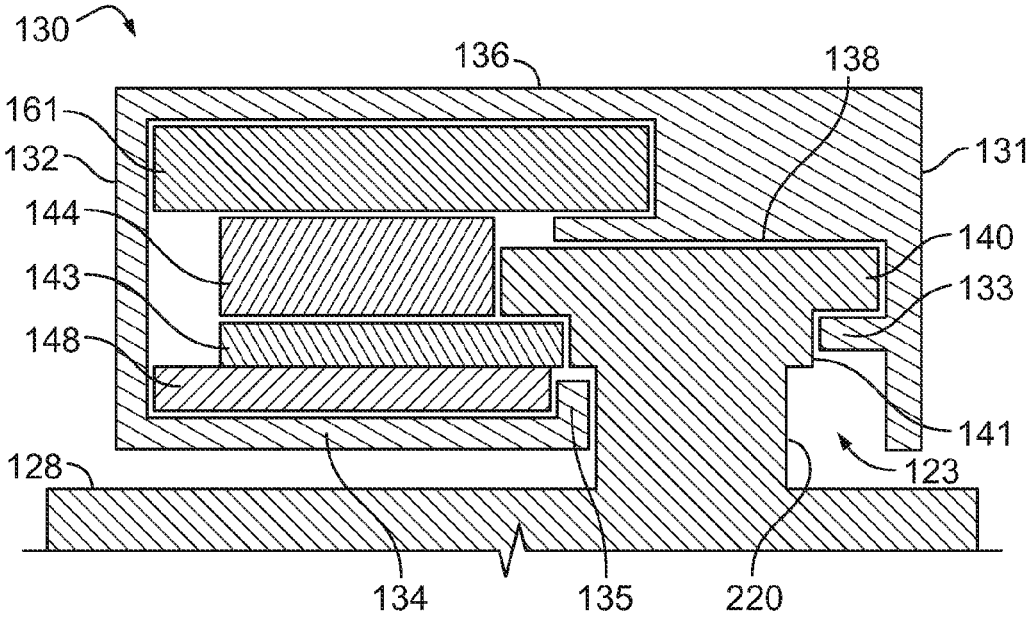
FIG. 18 is a cross-sectional view of the assembled mechanism.

As more specifically shown in FIG. 18, one of the flanges 134 extends approximately half way through the width of the track 130 and terminates in a small bead or ridge 135. The area defined by the roof 136 of the track, the side wall 132 and the flange 134 houses the components of the ratcheting assembly 137. In this way the ratcheting assembly essentially engages and operates on the packaged articles from a single direction, namely a single lateral side.

The head of each carrier is engaged in a channel 123 defined between the ridge 135 and flange 133 where the lower section 141 of the head rides along and in intermittent contact with a drive rack 143 in the shape of a plate, and the upper section 140 rides along and in intermittent contact with a friction structure in the form of a locking rack 144 also in the shape of a plate. The locking rack is substantially commensurate with and in sliding contact with the drive rack, and positioned immediately above it.

Figure 21:
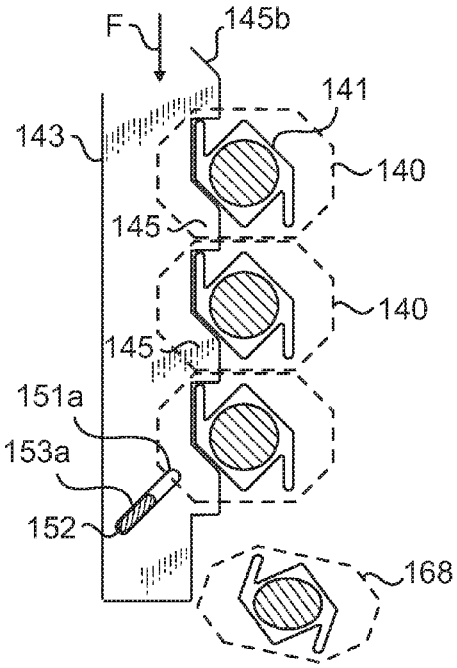
FIG. 21 is a diagrammatic top view of a queue of carriers being pushed forward by the drive rack in a first transversal position during a drive stroke.

Referring now to FIGS. 16, 18 and 21-23, the drive rack 143 has a series of uniformly spaced apart sawtooth-shaped prominences 145 along the edge facing and contacting the lower sections 141 of the heads. The prominences are shaped, dimensioned and positioned to propel the carriers forward in a first axial direction, as indicated by arrow F, toward a distribution station as the drive rack is held in a driving first transversal position as shown in FIG. 21.

The locking rack 144 has a series of uniformly spaced apart indentations 146 separated by substantially trapezoidal teeth along the edge facing and contacting the upper sections 140 of the heads 138. The indentations are shaped, dimensioned and positioned to capture the upper sections of the heads while the locking rack is held in a locking second crosswise location as shown in FIG. 20.

Figure 19:
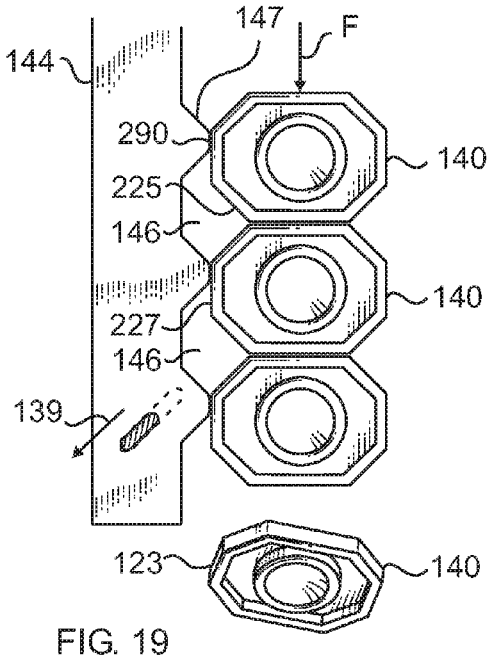
FIG. 19 is a diagrammatic top view of a queue of carriers being pushed forward by a drive stroke where the locking rack is pushed aside to an unlocking first crosswise position.

As shown in FIG. 19, during a drive stroke, the ramping front edges 147 of the indentations 146 of the locking rack 144 are contacted by the correspondingly angled surfaces 225 of the upper sections 140 of the carrier heads 138 as the latter are pushed forward which causes the locking rack to be translated obliquely sideways 139 to a unlocking first crosswise location shown in FIG. 19. This allows the side edges 227 of the upper sections 140 of the carrier heads to freely slide along the side edges 290 of the teeth.

Figure 20:
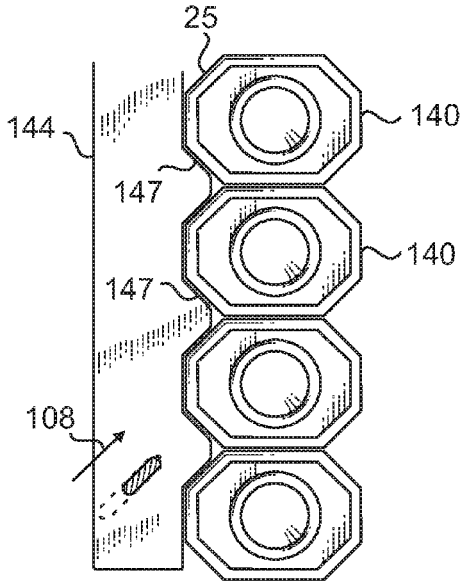
FIG. 20 is a diagrammatic top view of a queue of carriers held by the locking rack friction structure in the locking second crosswise position during a reset stroke.

As the upper sections 140 of the heads 138 reach the ends of the side edges 290 of the teeth, the locking rack 144 can snap back into a locking second crosswise location as shown in FIG. 20 as the upper sections of the heads fall into the next successive indentation 146. In this position the locking rack prevents the carriers from moving backwards as the drive rack 143 is withdrawn in a second axial direction opposite the first one during a reset stroke.

The movements of the drive rack 143 are controlled be a push rod 148 having a flat top surface 150 riding against the flat underside 149 of the drive rack. An opposite flat bottom surface of the push rod rides upon the flat upper surface 154 of the flange 134 of the track 130. A pair of short, oblong nibs 153*a*, 153*b* project upwardly from the top surface of the push rod into a corresponding pair of oblique grooves 151*a*, 151*b* cut into the drive rack. The nibs and the grooves are slanted at an angle of about 45 degrees to the travel axis X-X' of the rod and racks.

As shown in FIG. 21, during a drive stroke, as the push rod 148 moves forward, the nibs 153*a*,153*b* bear against the frontward ends 152 of their respective grooves 151*a*,151*b* thus pushing the drive rack 143 forward. The dimensioning of the nibs and grooves and the inertia of the carriers and appended packages prevent the drive rack from moving out of this driving first transversal position, thus keeping the drive rack engaged with the lower sections 141 of the heads during the drive stroke. The drive stroke completes when an endstop 164 on the push rod abuts against a surface 290 at the rear of the track 130 and a frontmost package 168 in the queue has been ejected.

Figure 22:
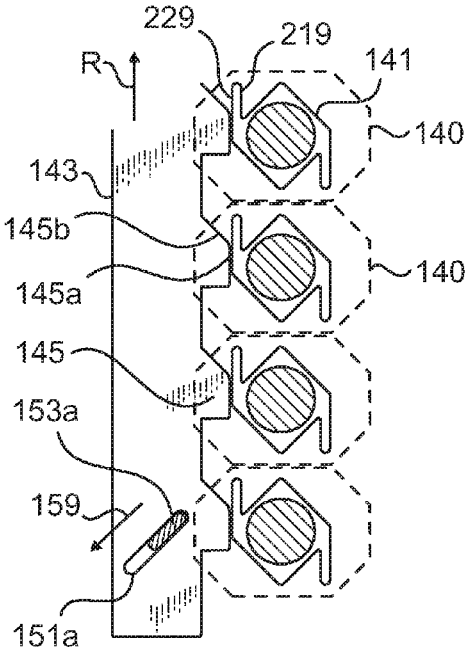
FIG. 22 is a diagrammatic top view of a queue of carriers where the drive rack has moved sideways to a second transversal position during a reset stroke.

As shown in FIG. 22, during a reset stroke, the drive rack 143 is intended to be axially withdrawn by moving in the rearward direction as indicated by the arrow R. During the reset stroke the locking rack 144 immobilizes the carriers as previously shown in FIG. 20. In order to allow the drive rack to pass over the lower sections 141 of the carrier heads which are being held in place by the locking rack, the ramping back edges 145*b* of the prominences 145 contact the lower sections of the carrier heads causing the drive rack 143 to be translated obliquely sideways 159 and progressively retracted toward a resetting second transversal position shown in FIG. 22. Simultaneously, the grooves 151*a*, 151*b* slide angularly over the nibs 153*a*, 153*b*. In this resetting second transversal position the flattened side edges 145*a* of the prominences freely slide along the side edges 229 of the lower sections 141. As the prominences pass over the distal ends of the prongs 219, the drive rack is allowed to snap back to its driving first tranversal position as shown in FIG. 21.

The drive rack is shifted back into its driving first transversal position in engagement with the carrier heads under the resilient movement of a pair of cantilever springs 155*a*, 155*b* acting on a pair of corresponding stubs 157*a*, 157*b* extending downward from the underside 149 of the drive rack into windows 160*a*, 160*b* cut into the push rod. The springs 155*a*, 155*b* consist of thin tongues projecting axially from a wall of each of the windows.

The push rod, drive rack and locking rack are stacked below a support plate 161. The locking rack 144 and support plate are coupled together by a mechanism of nibs 163*a*, 163*b*, slanted grooves 162*a*, 162*b*, stubs 165*a*, 165*b* and springs 167*a*, 167*b*, similar to the ones between the drive rack and the push rod. This mechanism conveniently controls the translation of the locking rack from a locking first crosswise location to an unlocking second crosswise location. It shall be understood that the drive rack and locking rack can slide independently from one another Referring now to FIG. 16, a barrier plate 169 clipped to the distal end of the push rod 148 limits its withdrawing movement. The push rod is activated by a reciprocating actuator preferably of the type illustrated in FIGS. 6-8. The push rod is withdrawn under the resilient force of a coil spring 170 compressed between an endplate 182 at the edge of the push rod and a screw 183 through the flange 134 of the track 130.

Figure 23:
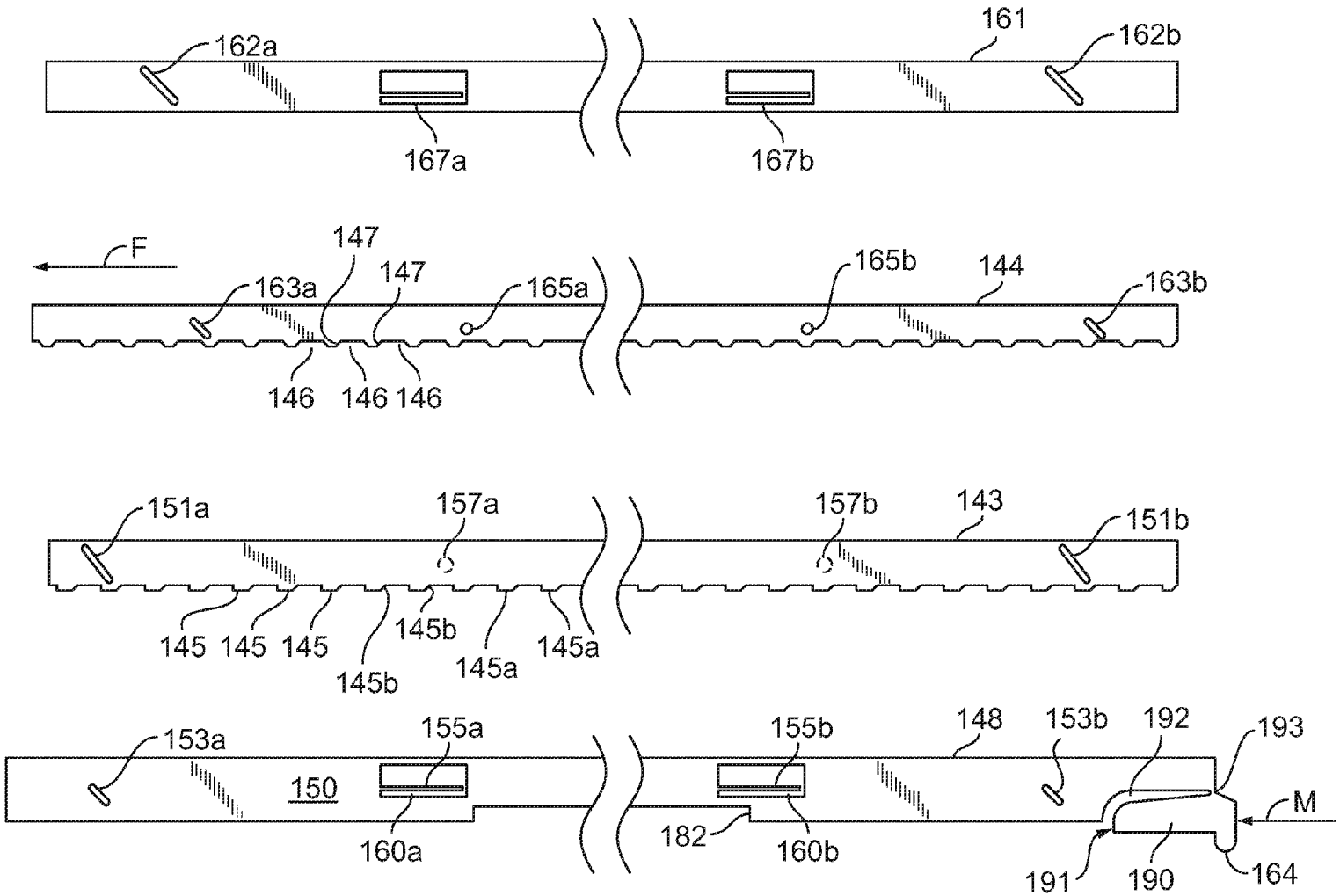
FIG. 23 is a diagrammatic top view of the support plate, the locking rack, the drive rack and the push rod.

As shown in FIG. 23, a tamper resistant spring-loaded, deflectable gate 190 is formed into the proximal end of the push rod 148 to restrict it forward movement unless the gate is tripped. When untripped, the forward motion of the push rod is prevented by an endstop 191 at the distal end of the gate which contacts a surface on the track. However, when the push rod is activated by the actuator, and a force M is applied axially on the proximal end of the gate, the gate is deflected into a commensurate nook 192 in the push rod. Resilient deflection is accomplished using a thin spit of material forming a cantilever spring 193 between the gate and the push rod body.

Referring now to FIGS. 24-27 there is shown an alternate embodiment of the ratcheting mechanism 337 using an alternate spring mechanism 301 for controlling the crosswise location of the locking rack and the transverse position of drive rack.

Figure 25:
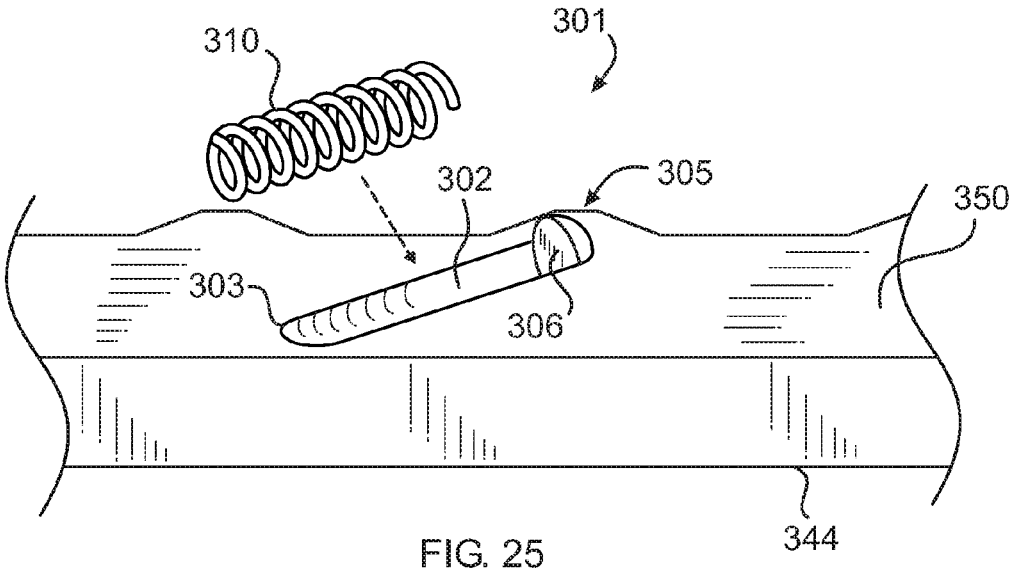
FIG. 25 is a diagrammatic perspective view of an alternate embodiment of a rack transversal position biasing spring mechanism.
Figure 26:
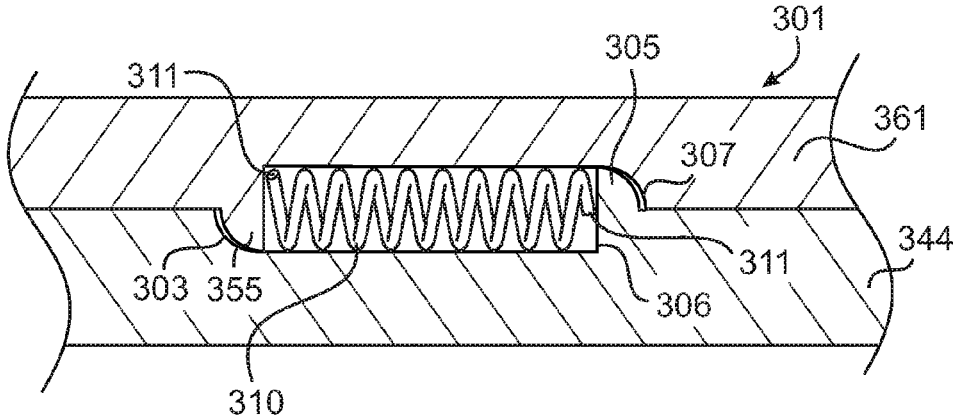
FIG. 26 is a diagrammatic cross-sectional view of the rack transversal position biasing spring mechanism in an uncompressed state.

As shown in FIGS. 25-26 an alternate spring mechanism 301 is formed between the locking rack 344 and support plate 361. The mechanism uses a pair of cooperating substantially semi-cylindrically shaped oblong trenches 302,352 formed into the opposing surfaces of the locking rack and support plate. The trench in the locking rack has a first semi-hemispherical end 303 and an opposite backstop structure 305.

The backstop structure 305 extends upwardly beyond the top surface 350 of the locking rack 344 and has a flattened circular front surface 306 oriented substantially perpendicular to the elongation axis of the trench 302 and an opposite semi-hemispherically shaped back surface 307. A similar trench 352 is formed into the undersurface 351 of the support plate 361 and oriented so that the backstop 355 of the support plate intimately and slidingly engages the trench 302 of the locking rack, and the backstop 305 of the locking rack intimately and slidingly engages the trench 352 of the support plate when the support plate and locking rack are brought together. The interface of the two mated trench and backstop structures forms a substantially cylindrical encasement for containing a coil spring 310 having ends 311 bearing against the circular inner surfaces of the respective backstops.

Figure 27:
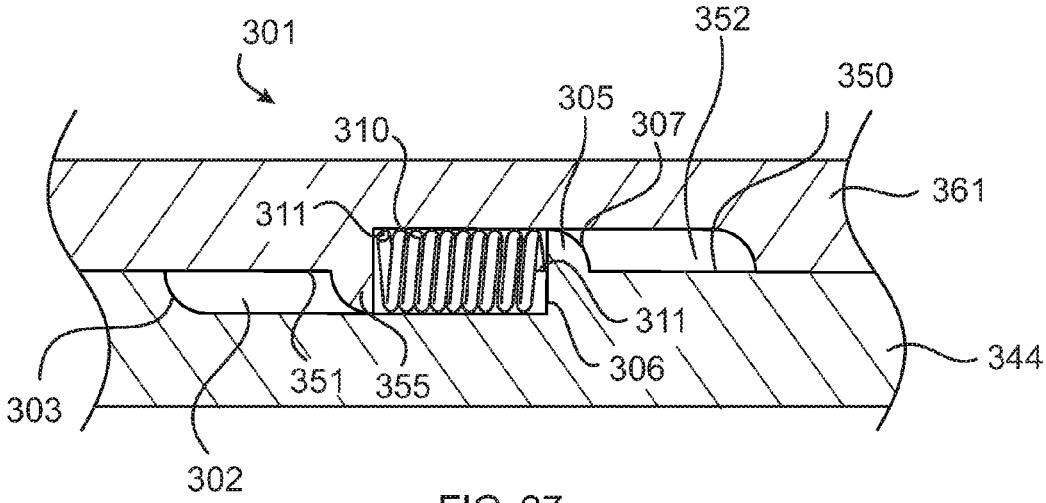
FIG. 27 is a diagrammatic cross-sectional view of the rack transversal position biasing spring mechanism in a compressed state.

In this way, the spring 310 biases the locking rack 344 toward a second locking crosswise location where the coil spring is in an uncompressed state as shown in FIG. 26 during a reset stroke. The resiliency of the spring is selected to allow compression of the spring and movement of the locking rack into a first crosswise location as shown in FIG. 27 during a drive stroke.

Figure 24:
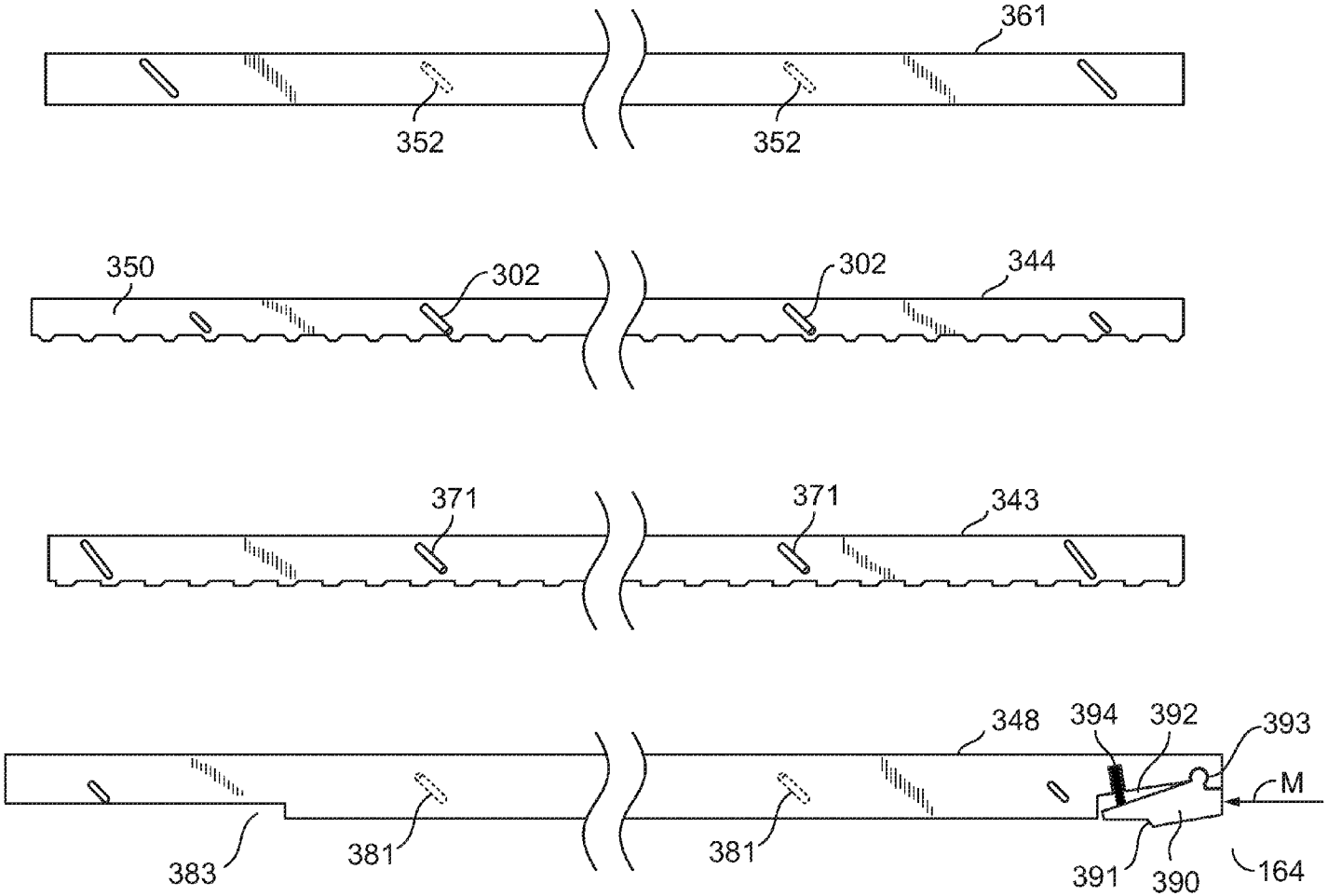
FIG. 24 is a diagrammatic top view of an alternate embodiment of the support plate, the locking rack, the drive rack and the push rod.

As shown in FIG. 24, a similar spring biasing mechanisms can be used between the drive rack 343 and the push rod 348 by forming angled trenches 371 in the drive rack, and forming interfacingly located and oriented angled trenches 381 in the push rod. In this way, the mechanisms can bias the drive rack toward a driving first transversal position where the coil spring is in an uncompressed state during a drive stroke, while allowing the drive rack to move into a resetting second transversal position during a reset stroke. Thus, the mechanisms can conveniently control the translation of the drive rack between transversal positions and the locking rack between crosswise locations.

Referring now to FIG. 24, there is shown an alternate embodiment of a tamper resistant spring-loaded, deflectable gate 390 is formed into the proximal end of the push rod 348 to restrict it forward movement unless the gate is tripped. When untripped, the forward motion of the push rod is prevented by an endstop 391 at the distal end of the gate which contacts a surface 290 on the track. However, when the push rod is activated by the actuator, and a force M is applied axially on the proximal end of the gate, the gate is deflected into a commensurate nook 392 in the push rod. Resilient deflection is accomplished using a hinge connection 393 between the gate and the push rod. The gate is biased toward the untripped state by a coil spring 394. In this embodiment the space 383 in the push rod for containing the reset coil spring is located near the distal end of the track for easier access.

Figure 28:
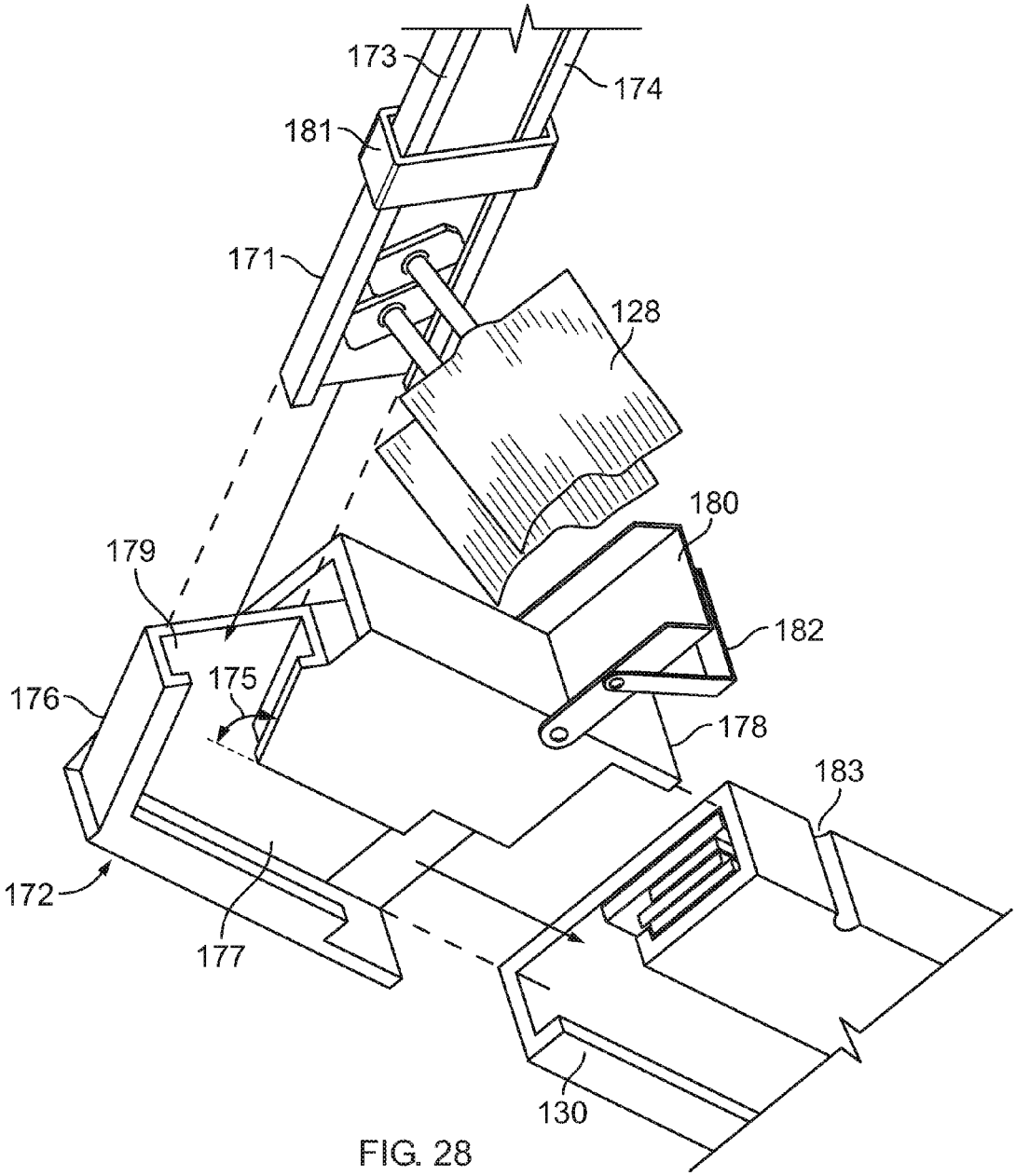
FIG. 28 is a diagrammatic bottom perspective view of the package loading coupler.
Figure 29:
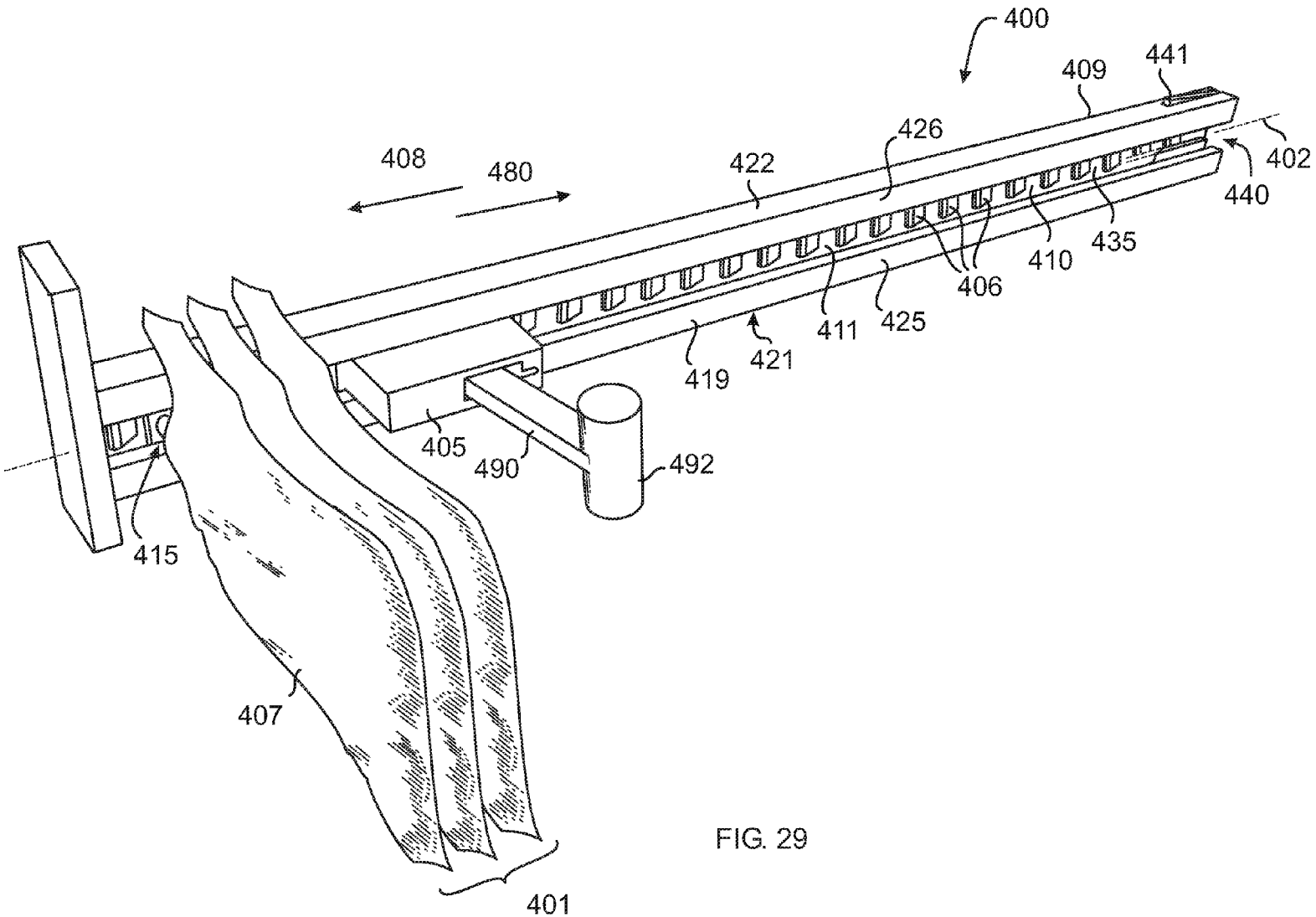
FIG. 29 is a diagrammatic bottom perspective view of an alternate queued item dispensing mechanism having a sliding, self-braking drive sled.

As shown in FIG. 28, batches of carrier-equipped packages 128 are commonly stored and shipped mounted on a loading rail 171. A coupler 172 is provided to connect the loading rail to the back of the dispensing track 130. For ease of storage and transportation, the packages are mounted on the loading rail in the illustrated angled orientation with respect to the major axis of the loading rail. More specifically, the larger first section of the carrier heads have a pair of their edges that are oblique, that is not parallel or perpendicular to the flat packages, retained by the flanges 173, 174 of the loading rail. Accordingly, the heads and packages are rotated with respect to the loading rail. When loaded onto the dispensing track 130 the packages are oriented perpendicular to the axis X-X' of the travel toward the dispensing end. In the case of an octagonal first head section, a 45 degree shift of direction 175 must be imposed. This shift is achieved by joining the receiving channel 176 of the coupler to the exit channel 177 at the required angle. The coupler is housed in a U-shaped bracket 178 dimensioned to mate with the cross-sectional periphery of the dispensing track 130. The loading channel aperture 179 is commensurate with the outer periphery of the loading rail 171. Once joined, the coupler forms an interfacing channel between the loading rail channel and the dispensing track channel through which the carriers can easily slide. A buckle 180 is provided having a swing-arm 182 for engaging a notch 183 in the dispensing track 130 to secure the coupler 172 to the dispensing track. A push ring 181 is engaged on the loading rail to manually urge the package toward the coupler.

Referring now to FIGS. 29-33, there is shown an alternate embodiment of the ratcheting, queued item dispensing mechanism 400 which uses a self-braking drive sled 405 for pushing the queue 401 of items such as single serving coffee packets 407 forward 408 along a support track 409 under the longitudinal reciprocating movement 460 of a crenelated drive rack 410. The track 409 has a generally oblong extruded structure along a longitudinal axis 402 shaped and dimensioned to form a longitudinal internal elongated channel 411 having a longitudinal bottom opening 412 for slidingly accommodating and supporting the queue of items by their top-mounted carriers 415.

Figure 30:
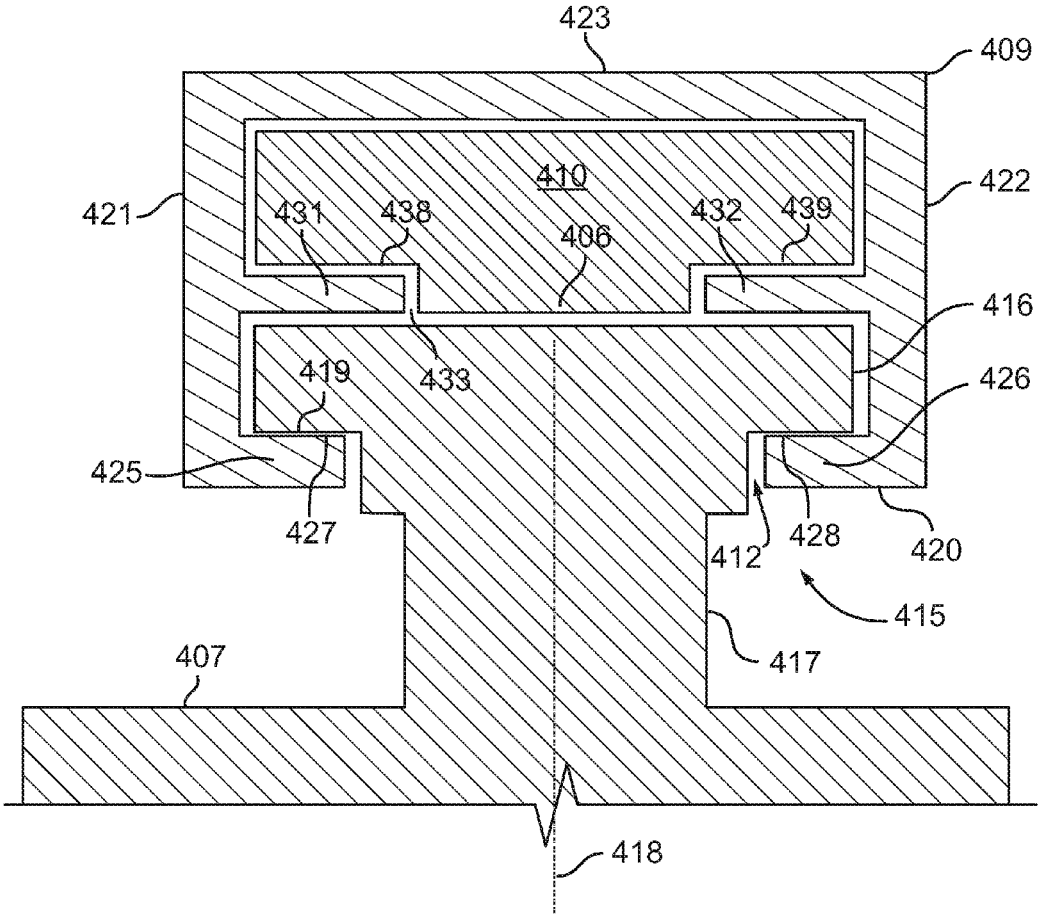
FIG. 30 is a diagrammatic cross-sectional end view of the track, drive rack and item head.

Referring now to FIG. 30 there is shown a cross-sectional view of the track 409 supporting the widened head 416 of a carrier 415 having a substantially cylindrical shank 417 secured to and projecting from an upper end of each packet 407 along a substantially vertical axis 418. The generally quadrangular C-shaped cross-section of the track is formed by a pair of substantially parallel, spaced apart side walls 421,422 extending substantially orthogonally downward from a substantially planar upper roof 423. A pair of lower flanges 425,426 project laterally and inwardly from the bottom ends of the side walls. The lower flanges are laterally spaced apart to form a central opening 412 through which the shank 417 of each of the carriers passes. The shape and dimension of the flanges and opening are selected to accommodate uninhibited passage of the packet carriers therethrough. Therefore, the width of the opening is at least as large as the diameter of the carrier shank.

Thus the upper surfaces 427,428 of the lower flanges form a bearing surface for the undersurface 419 of each carrier head 416. The undersurfaces 429,430 of the lower flanges form a bearing surface against which the sled braking mechanism operates, described in detail below. In this embodiment it is intended that the carriers slide freely longitudinally within the elongated channel in absence of any enhanced friction-inducing structure between the heads and the flanges, or other parts of the track, which would serve to inhibit backward motion of the packets during a reset motion of the drive rack. The presence of the self-braking sled 405 eliminates this requirement. In this way the friction of the track in the forward direction against the queue of items can be kept to a minimum.

The track 409 also has a pair of internal upper shelves 431,432 extending laterally inwardly from a medial portion of the sidewalls 421,422 toward one another to form support for the longitudinally reciprocating drive rack 410. The upper shelves are laterally spaced apart to form a gap 433 through which extends a plurality of equidistantly longitudinally spaced apart rigid ratcheting prominences 406 from the bottom surface 435 of the crenelated drive rack. The drive rack and prominences can be made from a unitary piece of rigid plastic to enhance durability. The width of the gap 433 is at least as large as the lateral width of the ratcheting prominences 406. The upper surfaces of the upper shelves form a bearing surface for bearing against the undersurface of the side ledges 438,439 of the drive rack. The drive rack ledges slide freely longitudinally against the upper surfaces of the upper shelves as the rack moves forward 408 during a drive stroke and backward 480 during a reset stroke. Lateral movement of the drive rack, carrier heads, and drive sled are restricted by the inner surface of the track side walls.

The drive rack 410 is moved longitudinally forward 408 during a drive stroke by the push on its rear, or proximal end 440 by the prong in the motor linkage as described earlier in connection with FIGS. 6-8. The rack is moved backward during a reset stroke through the force of one or more coil compression springs housed within the track as described earlier in connection with FIG. 16 and the spring 170. A tamper resistant spring-loaded deflectable gate 441, described earlier in connection with FIG. 24, is formed onto the proximal end 440 of the drive rack to restrict forward movement of the drive rack unless the gate is tripped by the force of drive motor linkage.

Figure 31:
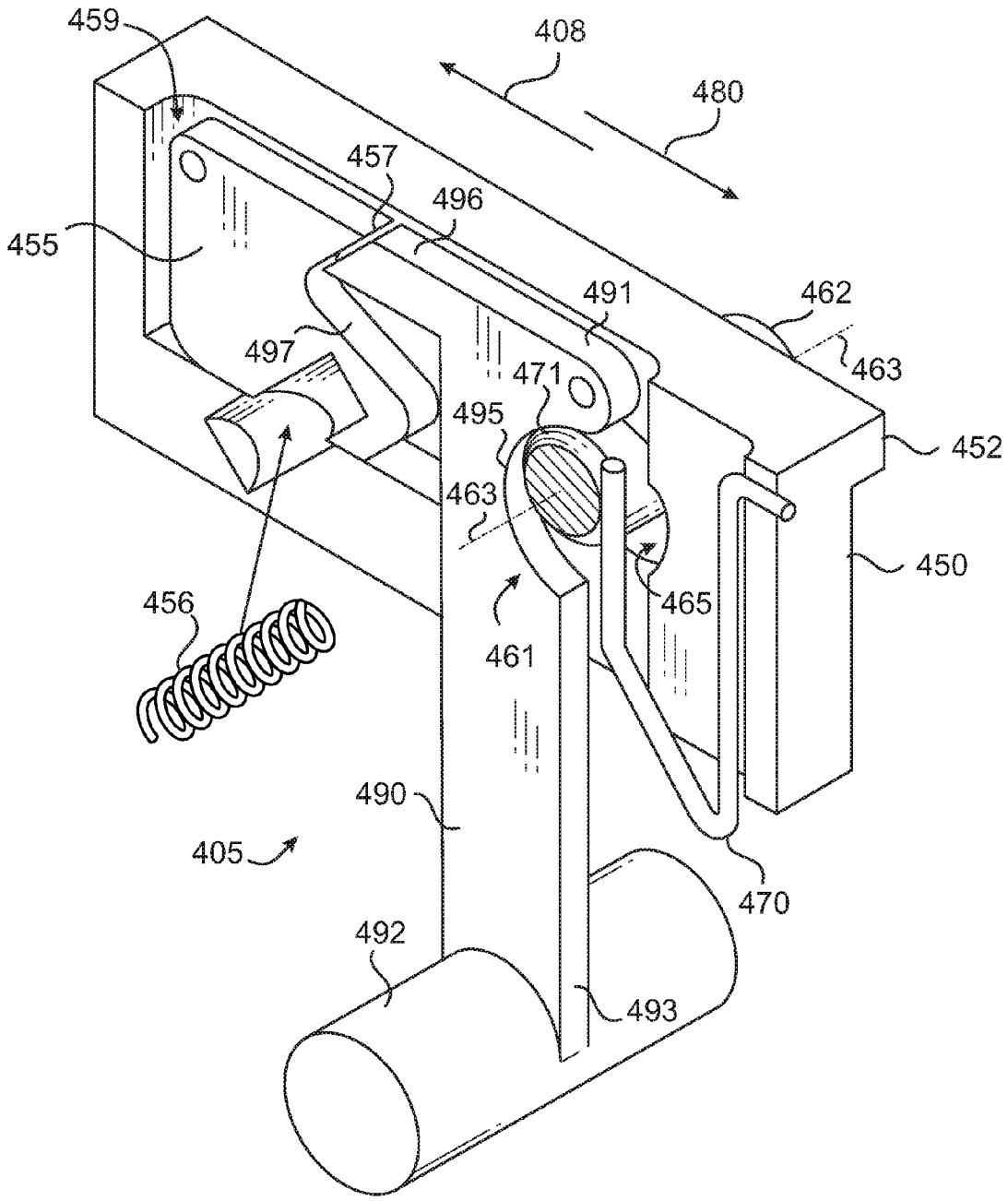
FIG. 31 is a diagrammatic perspective view of the sliding, self-braking drive sled.
Figure 32:
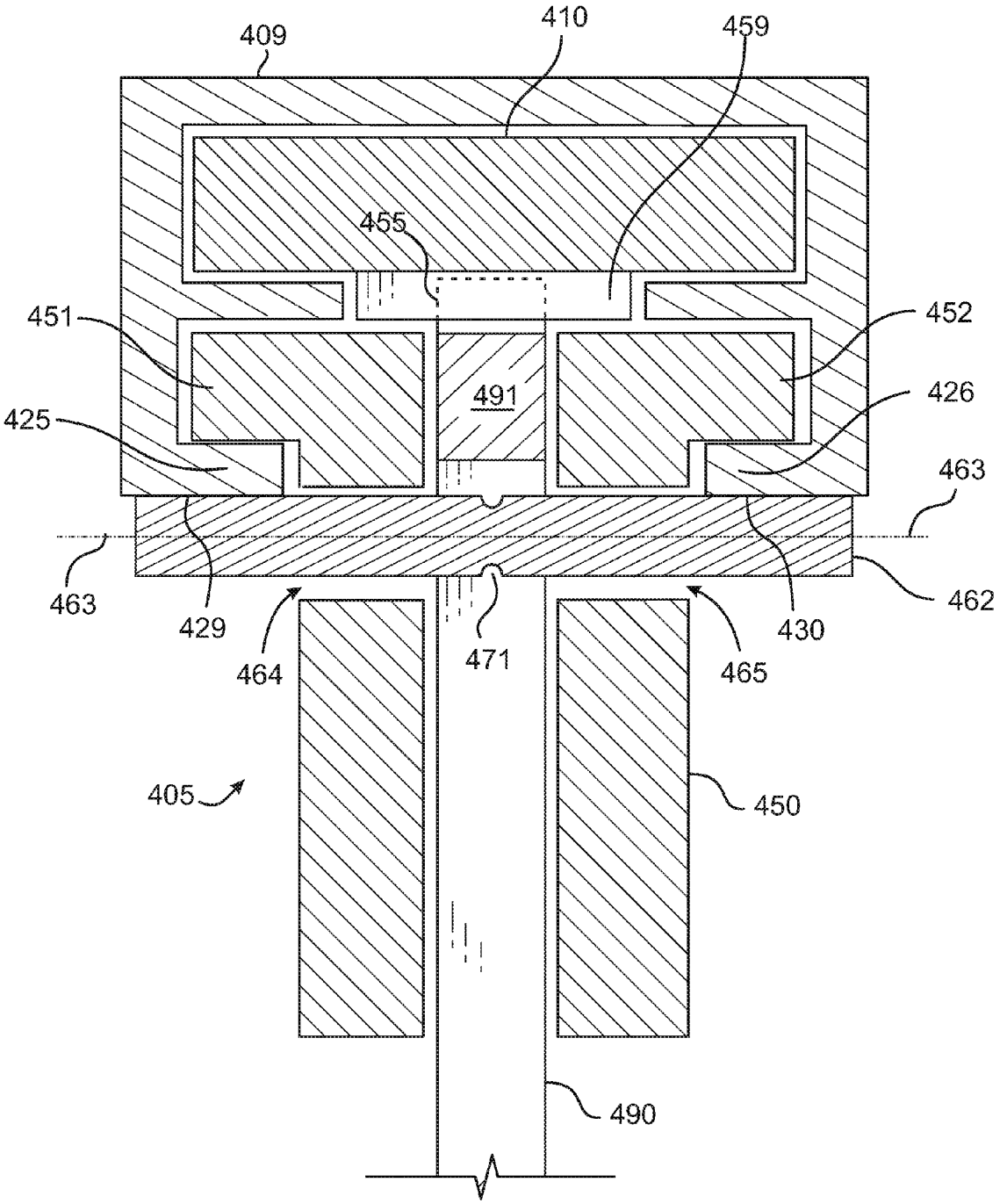
FIG. 32 is a diagrammatic cross-sectional end view of the track, drive rack and sled.
Figure 33:
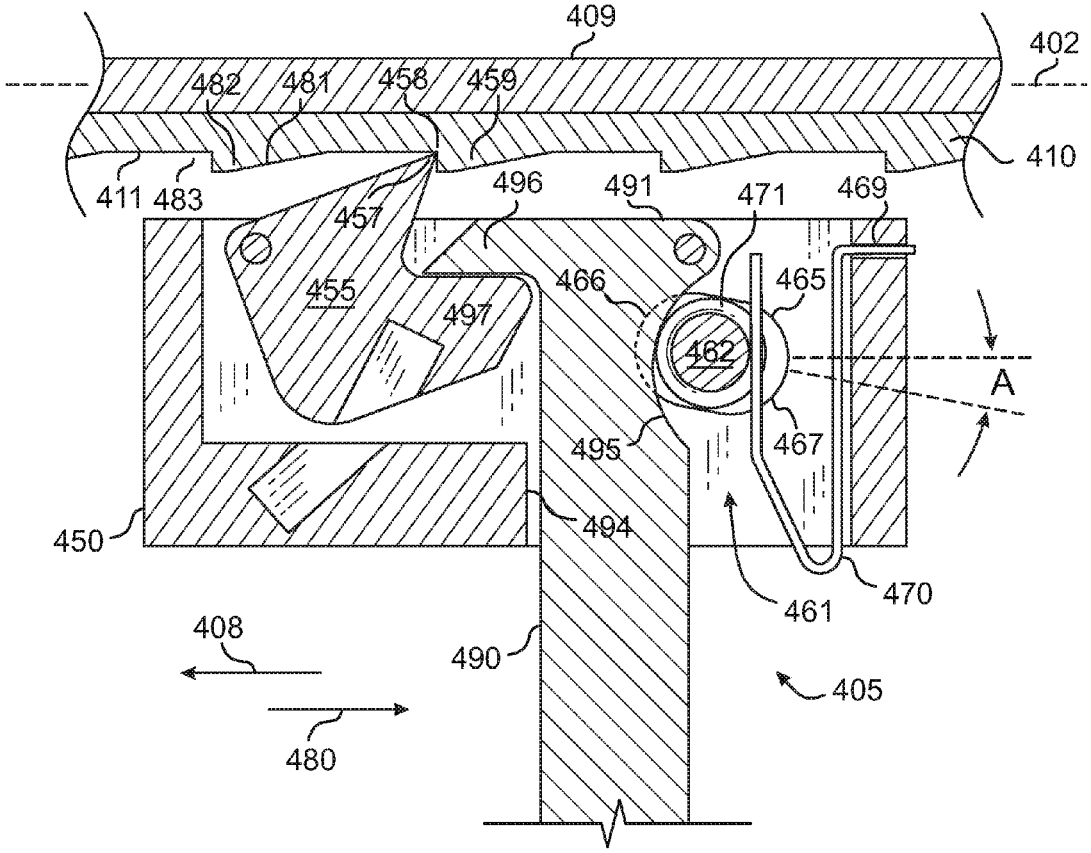
FIG. 33 is a diagrammatic cross-sectional side view of the self-braking drive sled slidingly mounted on a track and being driven by a crenelated drive rack.

Referring now to FIGS. 31-33, there is shown the self-braking drive sled 405 for successively pushing the queue of items forward 408 during each drive stroke. The sled has a substantially quadrangular body 450 housing mechanisms for allowing the sled to be successively engaged by and pushed forward by the drive rack 410 during a drive stroke, and disengaged from the drive rack and remain substantially stationary on the track 409 during a reset stroke. A pair of ears 451,452 extend laterally from the top edge 453 of the body. The ears are shaped and dimensioned to slidingly engage the elongated channel of the track 410 in a manner similar to the heads of the carriers.

During a drive stroke the crenelated drive rack 410 is caused to slide forward 408 along the track 409. The sled 405 uses a spring loaded pawl 455 which is biased upwardly against the rack by a compression spring 456 loaded in opposing hollow cylindrical trenches in the pawl body and sled body. The distal tip 457 of the pawl is sized, shaped, oriented and located to catch in the crook 458 of one of a series of spaced apart prominences 459 extending downwardly from the bottom surface 411 of the drive rack 410. Each of the prominences has a substantially sawtooth-shaped cross-section to facilitate grabbing hold of the sled pawl during the drive stroke, and sliding over the sled pawl during a reset stroke. Thus the sled is pushed forward along with the drive rack, pushing the queue of items from behind and resulting in the ejection of the front-most item in the queue.

During a reset stroke, the sled 405 is immobilized with respect to the track 409 by an automatically engaging brake mechanism 461 formed by a transversely oriented substantially cylindrical wedging post 462 having a major axis 463. The post is made from a material that can frictionally wedge against the underside 429,430 of the lower flanges 425,426 of the track. The post is mounted through a pair of aligned oval foramen 464,465 through the lateral side walls of the sled body 450 so that the major axis 463 of the post is transverse to the longitudinal axis 402 of the track. The oval foramen are oriented at an angle A with the horizontal so that the front end 466 of the foramen is upward and the rear end 467 of the foramen is downward. A leaf spring 470 biases the post toward the front, upper end of the foramen so that the post rests against the underside of the lower flanges. The leaf spring contacts the post along a central circumferential groove 471 to prevent movement of the post along its major axis 463. The leaf spring is held in place by engaging a hole 469 through the sled body. During a reset stroke, any slight rearward movement of the sled causes the post to ride further up the foramen and wedge more tightly against the undersurface 419,420 of the track. This acts to increase friction between the post and track and thus brake the rearward motion of the sled. With the sled remaining in place, the reset motion 480 of the drive rack 410 moves the angled ramp 481 of the next successive prominence 482 onto the pawl 455 causing it to retract into its passageway 459. The rack continues to slide over the stationary sled until the pawl tip 457 snaps back into the next gap 483 between adjacent prominences.

During a drive stroke on the other hand, contact between the post 462 and track 409 causes the post to move substantially rearwardly 480 in the foramen and thus downwardly away from the track, thereby de-wedging it and reducing friction, thereby allowing the sled 405 to be driven forward 408 in an un-braked manner.

A swing arm 490 is hingedly mounted at its upper end 491 to the sled body 450. A weight 492 is secured to its lower end 493 to keep the swing arm in a substantially vertical orientation. An endstop 494 prevents the lower end of the swing arm from swinging forward. Rearward swinging of the lower end causes the swing arm to contact the post 462 and push it rearward 480 in the oval slot toward an unlocking position. An arcuate notch 495 in the swing arm adjusts when that contact will occur. Simultaneously, rearward swinging of the swing arm will also cause a prong 496 projecting forwardly from the upper end 491 of the swing arm to contact a lower ledge 497 on the hinged pawl 455, and push it downwardly, thus retracting the pawl into its passageway 459 and away from the prominences 459,482 of the drive rack 410. This effectively disengages the pawl and braking mechanisms on the sled allowing it to slide freely along the track. The weighted swing arm also effectively disengages the sled from the drive rack when the track is tilted in a front up orientation. This allows the sled to slide freely off the back of the track to facilitate a cartridge refill operation. The swing arm also acts as an easily graspable handle for a service person to manually remove or change the position of the sled.

While exemplary embodiments of the invention have been described, modifications can be made and other embodiments may be devised without departing from the spirit of the invention and the scope of the appended claims.

The invention claimed is:

1. A device for selectively dispensing a plurality of items, wherein each of said items has a carrier uniformly shaped and dimensioned with respect to others of said items, said device comprises:

at least one elongated track for carrying a queue of said items, said track comprising:

an elongated channel having a frontal dispensing aperture, a back loading aperture, and a cross-section commensurate with a cross-sectional dimension of said carrier; and, a ratcheting mechanism alternately allowing dispensing of a first one of said items through said frontal aperture and holding back a second one of said items next in line behind said first one;

wherein said ratcheting mechanism comprises:

a first rack slidingly and reciprocatingly secured with respect to said track, said first rack having a drive motion and a reset motion; said first rack carrying a plurality of spaced apart prominences;

a drive sled arranged to successively engage at least one of said prominences and drive forward said carriers while said first rack moves in said drive motion; and, a friction structure retaining said carriers from moving backward while said first rack moves in said reset motion.

2. The device of claim 1, wherein said sled comprises a retractable pawl having a pawl tip contacting said prominences.

3. The device of claim 2, wherein each of said prominences are substantially sawtooth shaped.

4. The device of claim 1, wherein said friction structure comprises a brake mechanism associated with said sled to successively immobilize said sled while said rack moves in a reset stroke.

5. The device of claim 1, wherein said brake mechanism comprises a movable wedging post which wedges more tightly between said sled and said track during slight rearward movement of said sled with respect to said track, and wedges less tightly during forward movement of said sled with respect to said track.

6. The device of claim 5, which further comprises a weighted swing arm hingedly connected to said sled, wherein rearward motion of said swing arm disengages said pawl tip from said drive rack and causes de-wedging of said post.

7. The device of claim 1,which further comprises:

a plurality of said tracks are assembled into a magazine;

a base unit comprising a cradle shaped and dimensioned to lockingly nest a portion of said magazine; and means for selectively activating a drive stroke in one of said plurality of tracks.

8. The device of claim 7, wherein said cradle provides a fulcrum surface oriented to bear against said magazine causing angular movement of said magazine.

9. The device of claim 7, wherein said magazine is detachable from said base unit.

10. The device of claim 7, wherein said means for activating comprise a reciprocating motor driven bolt oriented to mechanically engage said rack and thereby cause said drive stroke.

11. The device of claim 10, which further comprises:

a motor having a rotatable shaft;

a linkage between said shaft and said bolt, said linkage comprising:

a substantially circular disk rotatively held within a bearing, said disk having an axis of rotation;

a pin radially spaced apart from said axis; and, said bolt having an oblong slot slidingly and rotatively engaged by said pin.

12. The device of claim 1, wherein said magazine comprises a modular arrangement of spaced apart plates and crosspieces mechanically securing said tracks within an array of cartridges, wherein an additional one of said plates adds either a row or column to said array.

13. The device of claim 1, wherein said device further comprises:

said at least one track having a C-shaped cross section, parallel side walls and inwardly extending support flanges;

wherein said carrier includes a head engaged into said track and a shank projecting from said head between said flanges;

wherein said first rack is a drive rack inserted into said track and having a plurality of substantially sawtooth-shaped prominences shaped and positioned to capture and propel a sled engaged into said track behind a last one of said items when said drive rack is moved axially in a first axial direction, and to course over said sled when said drive rack is moved axially in a second axial direction;

wherein said friction structure comprises a braking mechanism associated with said sled;

said braking mechanism resisting rearward motion of said sled when said rack is moved axially in said second axial direction; and a mechanism for alternately moving said drive rack in said directions.

14. The device of claim 1, which further comprises:

said items being mounted on a loading rail;

a coupler mounted to said back loading aperture, said coupler having a first interface for releasably mating to an end of said loading rail, said coupler being shaped dimensioned and located to form a open interfacing channel between said loading rail and said elongated channel.

15. The device of claim 1; wherein said ratcheting mechanism comprises:

a spring resiliently biasing said drive rack toward one of said directions; and an actuator successively pulsing said rod against said spring.

16. A device for selectively dispensing a plurality of items, wherein each of said items has a carrier uniformly shaped and dimensioned with respect to others of said items, said device comprises:

at least one elongated track for carrying a queue of said items;

a sled slidingly mounted to said track for pushing a last one of said items in said queue forward during a dispensing action for dispensing a front one of said items in said queue;

wherein said sled comprises:

a body having an upper section including a pair of extensions extending laterally from opposite sides of said section sized to slidingly engage said track;

a transverse brake post having first and second ends extending laterally from said body to contact an undersurface of said track;

said brake post being slidingly and rotatively secured to said body; and, said body being shaped and dimensioned to have a transverse oblong foramen defining a range of motion for said post;

said range of motion including a wedged position and a de-wedged.

17. The device of claim 16, wherein said foramen is oval shaped.

* * * * *